US011209764B2

(12) United States Patent
Oshiro

(10) Patent No.: US 11,209,764 B2
(45) Date of Patent: Dec. 28, 2021

(54) IMAGE FORMING APPARATUS WITH MOVABLE CAM

(71) Applicant: TOSHIBA TEC KABUSHIKI KAISHA, Tokyo (JP)

(72) Inventor: Toshiaki Oshiro, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/925,531

(22) Filed: Jul. 10, 2020

(65) Prior Publication Data

US 2021/0181667 A1 Jun. 17, 2021

(30) Foreign Application Priority Data

Dec. 13, 2019 (JP) ..... JP2019-225655

(51) Int. Cl.
*G03G 15/00* (2006.01)
*G03G 21/18* (2006.01)

(52) U.S. Cl.
CPC ..... *G03G 15/6558* (2013.01); *G03G 15/6514* (2013.01); *G03G 21/1832* (2013.01); *G03G 15/6511* (2013.01); *G03G 2215/00392* (2013.01); *G03G 2215/00396* (2013.01)

(58) Field of Classification Search
CPC ..... G03G 15/6558; G03G 21/1832; G03G 15/6511; G03G 15/6514; G03G 2215/00392; G03G 2215/00379; G03G 2215/00396; G03G 2215/004
See application file for complete search history.

(56) References Cited

U.S. PATENT DOCUMENTS 8,020,850 B1 * 9/2011 Blair ..... B65H 1/14 271/9.11
2013/0270764 A1 * 10/2013 Mizuno ..... G03G 15/6511 271/10.11

FOREIGN PATENT DOCUMENTS

JP 2009-256051 A 11/2009

* cited by examiner

*Primary Examiner* — Walter L Lindsay, Jr.
*Assistant Examiner* — Laura Roth
(74) *Attorney, Agent, or Firm* — Foley & Lardner LLP

(57) ABSTRACT

An image forming apparatus includes a paper tray, an elevating plate, a cam, and a shutter. The paper tray is configured to hold sheets. The elevating plate on the paper tray is arranged to ascend and descend between a descended position and an ascended position higher than the descended position. The cam is movable between a first position and a second position. The shutter includes a shielding portion. The shielding portion is located at a shielding position when the cam moves to the first position. The shielding position is a position that overlaps with a region in a height direction occupied by the cam at the second position. The shielding portion retracts from the shielding position when the cam has moved from the first position to the second position.

14 Claims, 14 Drawing Sheets

IMAGE FORMING APPARATUS WITH MOVABLE CAM

CROSS-REFERENCE TO RELATED APPLICATION

This application is based upon and claims the benefit of priority from Japanese Patent Application No. 2019-225655, filed Dec. 13, 2019, the entire contents of which are incorporated herein by reference.

FIELD

Embodiments described herein relate generally to an image forming apparatus.

BACKGROUND

The image forming apparatus includes a paper feed unit such as a manual paper feed. The paper feed unit includes an elevating plate that pushes up a sheet placed on a paper tray from below to the position of a pickup roller. The elevating plate may be automatically ascended and descended by an elevating mechanism.

The manual paper feed is arranged outside the image forming apparatus at the time of use. Since the elevating mechanism includes a movable portion, it is necessary to prevent the user's finger from entering an opening portion around the elevating mechanism when using the manual paper feed.

If the paper feed unit is miniaturized, the opening around the elevating mechanism may become large when the elevating plate is lowered.

DETAILED DESCRIPTION

The problem to be solved by the present disclosure is to provide an image forming apparatus capable of reducing an opening portion around an elevating mechanism when ascending and descending an elevating plate in a manual paper feed.

In general, according to at least one embodiment, an image forming apparatus includes a paper tray, an elevating plate, a cam, and a shutter. The paper tray is configured to hold sheets. The elevating plate is arranged on the paper tray. The elevating plate is arranged to ascend and descend between a descended position for setting a sheet of the sheets and an ascended position higher than the descended position. The cam is movable between a first position and a second position. The first position is a position where the elevating plate is arranged at the descended position. The second position is a position where the elevating plate moves to the ascended position. The shutter includes a shielding portion. The shielding portion is located at a shielding position when the cam moves to the first position. The shielding position is a position that overlaps with a region in a height direction occupied by the cam at the second position. The shielding portion retracts from the shielding position by the time the cam moves from the first position to the second position.

Hereinafter, an image forming apparatus according to at least one embodiment will be described with reference to the drawings.

Figure 1:
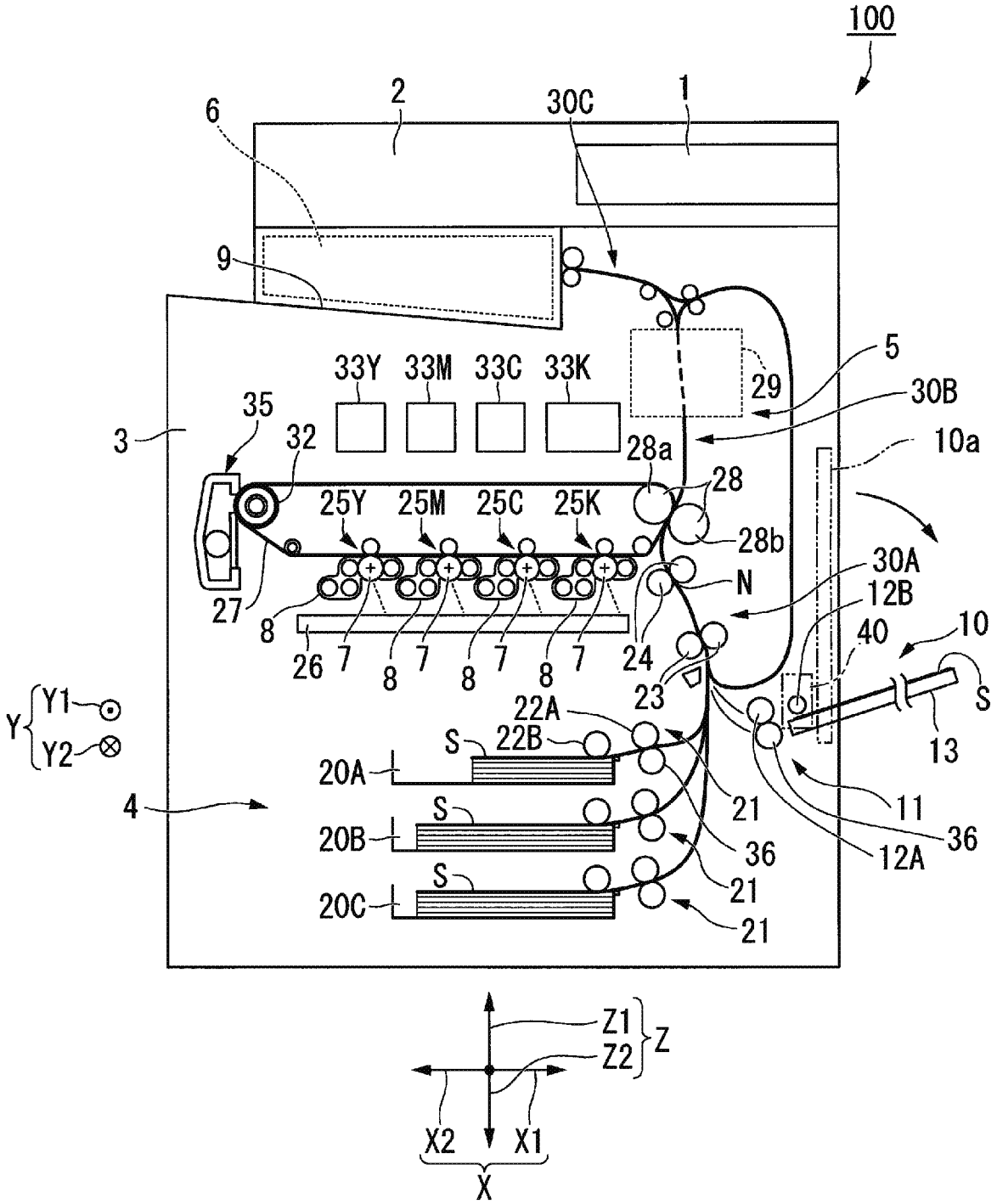
FIG. 1 is a schematic cross-sectional view showing a configuration example of an image forming apparatus according to at least one embodiment.

FIG. 1 is a schematic cross-sectional view showing an example of an overall configuration of the image forming apparatus according to at least one embodiment. In each of the following drawings, the same or corresponding components are denoted by the same reference numerals unless otherwise specified. Examples of the configurations corresponding to each other include a configuration having a plane-symmetric shape with respect to an appropriate plane.

As shown in FIG. 1, an image forming apparatus 100 of the present embodiment includes a control panel 1, a scanner unit 2, a printer unit 3, a sheet supply unit 4, a conveyance unit 5, a manual feed unit 10, and a control unit 6.

Hereinafter, when referring to the relative position in the image forming apparatus 100, the X1 direction, the X2 direction, the Y1 direction, the Y2 direction, the Z1 direction, and the Z2 direction shown in the drawings may be used. The X1 direction is a direction from left to right when standing in front of the image forming apparatus 100 (on the front side of the paper surface of FIG. 1). The X2 direction is opposite to the X1 direction. The Y1 direction is a direction from the back surface to the front surface of the image forming apparatus 100. The Y2 direction is opposite to the Y1 direction. The Z1 direction is a vertically upward direction. The Z2 direction is a vertically downward direction. When the directions of the X1 (Y1, Z1) direction and the X2 (Y2, Z2) direction do not matter or both directions are included, they are simply referred to as the X (Y, Z) direction.

Hereinafter, a plane having a normal line in the X direction will be referred to as a YZ plane, a plane having a normal line in the Y direction will be referred to as a ZX plane, and a plane having a normal line in the Z direction will be referred to as an XY plane. The ZX plane is a plane parallel to the conveyance direction of a sheet S described below in the image forming apparatus 100. The XY plane is a horizontal plane.

The control panel 1 operates the image forming apparatus 100 by the operation of a user.

The scanner unit 2 reads image information of an object to be copied based on brightness and darkness of light. The scanner unit 2 outputs the read image information to the printer unit 3.

The printer unit 3 forms an image on the sheet S based on image information from the scanner unit 2 or the outside.

The printer unit 3 forms an output image (toner image) with a developer containing toner. The printer unit 3 transfers the toner image to the surface of the sheet S. The printer unit 3 applies heat and pressure to the toner image on the surface of the sheet S to fix the toner image onto the sheet S.

The sheet supply unit 4 supplies the sheets S one by one to the printer unit 3 at the timing when the printer unit 3 forms a toner image.

The sheet supply unit 4 includes paper feed cassettes 20A, 20B, and 20C, and a plurality of cassette paper feed units 21.

The paper feed cassettes 20A, 20B, and 20C store sheets S of various sizes.

The plurality of cassette paper feed units 21 are arranged above the ends of the paper feed cassettes 20A, 20B, and 20C in the X1 direction. Each cassette paper feed unit 21 includes a pickup roller 22B, a paper feed roller 22A, and a separation roller 36.

Each pickup roller 22B conveys the sheet S required for image formation from the paper feed cassettes 20A, 20B, and 20C to a nip portion between the paper feed roller 22A and the separation roller 36.

Each paper feed roller 22A conveys the sheet S conveyed to the nip portion to the conveyance unit 5.

Each separation roller 36 separates one sheet S when a plurality of sheets S are conveyed.

The conveyance unit 5 includes conveyance rollers 23 and registration rollers 24. The conveyance unit 5 conveys the sheet S supplied from the sheet supply unit 4 to the registration rollers 24.

The registration rollers 24 convey the sheet S at the timing when the printer unit 3 transfers the toner image to the sheet S.

The conveyance rollers 23 abut a leading end of the sheet S in the conveyance direction against a nip N of the registration rollers 24. The conveyance rollers 23 adjust the position of the leading end of the sheet S in the conveyance direction by bending the sheet S.

The registration rollers 24 align the leading end of the sheet S delivered from the conveyance rollers 23 at the nip N. Further, the registration rollers 24 convey the sheet S to a transfer unit 28 side described later.

The conveyance unit 5 includes conveyance paths 30A, 30B, 30C, and 30D. The conveyance paths 30A, 30B, 30C, and 30D will be described after the other configurations of the printer unit 3 are described.

The printer unit 3 includes image forming units 25Y, 25M, 25C, and 25K, an exposure unit 26, an intermediate transfer belt 27, the transfer unit 28, a fixing device 29, and a transfer belt cleaning unit 35.

The image forming units 25Y, 25M, 25C, and 25K are arranged in this order in the X1 direction.

Each of the image forming units 25Y, 25M, 25C, and 25K forms a toner image to be transferred onto the sheet S on the intermediate transfer belt 27.

The image forming units 25Y, 25M, 25C, and 25K each include a photosensitive drum 7. The image forming units 25Y, 25M, 25C, and 25K form yellow, magenta, cyan, and black toner images on the respective photosensitive drums 7.

A charger, a developing device 8, a primary transfer roller, a cleaning unit, and a charge eliminator are arranged around each photosensitive drum 7. The primary transfer roller faces the photosensitive drum 7. The intermediate transfer belt 27 is interposed between the primary transfer roller and the photosensitive drum 7. The exposure unit 26 is arranged below the charger and the developing device 8.

Toner cartridges 33Y, 33M, 33C, and 33K are arranged above the image forming units 25Y, 25M, 25C, and 25K. The toner cartridges 33Y, 33M, 33C, and 33K contain yellow, magenta, cyan, and black toners, respectively.

The toner of each of the toner cartridges 33Y, 33M, 33C, and 33K is supplied to the image forming units 25Y, 25M, 25C, and 25K by a toner supply pipe (not shown).

The exposure unit 26 irradiates the surface of each charged photosensitive drum 7 with laser light. The emission of the laser light is controlled based on the image information. The exposure unit 26 can also adopt a configuration in which LED light is emitted instead of the laser light. In the example shown in FIG. 1, the exposure unit 26 is arranged below the image forming units 25Y, 25M, 25C, and 25K.

The exposure unit 26 is supplied with image information corresponding to each of yellow, magenta, cyan, and black.

The exposure unit 26 forms an electrostatic latent image based on image information on the surface of each photosensitive drum 7.

The intermediate transfer belt 27 is an endless belt. Tension is applied to the intermediate transfer belt 27 by a plurality of rollers abutting on the inner peripheral surface. The intermediate transfer belt 27 is stretched flat. The inner peripheral surface of the intermediate transfer belt 27 is in contact with a support roller 28*a* at the most spaced-apart position in the X1 direction in the stretching direction. The inner peripheral surface of the intermediate transfer belt 27 is in contact with a transfer belt roller 32 at the most spaced-apart position in the X2 direction in the stretching direction.

The support roller 28*a* forms apart of the transfer unit described later. The support roller 28*a* guides the intermediate transfer belt 27 to a secondary transfer position.

The transfer belt roller 32 guides the intermediate transfer belt 27 to the cleaning position.

On the lower surface side of the intermediate transfer belt 27 in the drawing, the image forming units 25Y, 25M, 25C, and 25K excluding the primary transfer roller are arranged in this order in the X1 direction. The image forming units 25Y, 25M, 25C, and 25K are arranged in a region between the transfer belt roller 32 and the support roller 28*a* with a space therebetween.

A transfer bias is applied to each of the primary transfer rollers of the image forming units 25Y, 25M, 25C, and 25K when the toner image reaches the primary transfer position. Each primary transfer roller transfers (primary transfers) the toner image on the surface of each photosensitive drum 7 to the intermediate transfer belt 27.

On the intermediate transfer belt 27, the transfer unit 28 is arranged at a position adjacent to the image forming unit 25K.

The transfer unit 28 includes the support roller 28*a* and a secondary transfer roller 28*b*. The secondary transfer roller 28*b* and the support roller 28*a* have the intermediate transfer belt 27 interposed therebetween. The position where the secondary transfer roller 28*b* and the intermediate transfer belt 27 contact each other is the secondary transfer position.

The transfer unit 28 transfers the charged toner image on the intermediate transfer belt 27 to the surface of the sheet S at the secondary transfer position. The transfer unit 28 applies a transfer bias to the secondary transfer position. The transfer unit 28 transfers the toner image on the intermediate transfer belt 27 to the sheet S by the transfer bias.

The fixing device 29 applies heat and pressure to the sheet S. The fixing device 29 fixes the toner image transferred to the sheet S by the heat and pressure. The fixing device 29 is arranged above the transfer unit 28.

The transfer belt cleaning unit 35 faces the transfer belt roller 32. The transfer belt cleaning unit 35 holds the intermediate transfer belt 27. The transfer belt cleaning unit 35 scrapes off the toner on the surface of the intermediate transfer belt 27.

The conveyance paths 30A and 30B for conveying the sheet S from the lower side to the upper side are respectively formed in this order between the registration roller 24 and the transfer unit 28 and between the transfer unit 28 and the fixing device 29.

Each of the conveyance paths 30A, 30B, and 30C includes conveyance guide units that face each other with the sheet S interposed therebetween and a conveyance roller that is provided as necessary.

The manual feed unit 10 supplies the sheet S on which an image is formed to the printer unit 3.

The manual feed unit 10 includes a manual paper feed unit 11, a manual feed tray 13 (paper tray), and an elevating mechanism 40.

The manual feed tray 13 is rotatable about an axis extending in the Y direction. When the manual feed tray 13 is used, as indicated by the solid line, the manual feed tray 13 is rotated clockwise to be opened. Sheets S of various sizes can be placed on the opened manual feed tray 13.

When the manual feed tray 13 is not used, as indicated by the chain double-dashed line, the manual feed tray 13 is rotated counterclockwise in the drawing and accommodated in the side portion of the printer unit 3 in the X1 direction.

The manual paper feed unit 11 separates and feeds the sheet S placed on the manual feed tray 13 and conveys the sheet S toward the registration rollers 24.

The manual paper feed unit 11 includes a pickup roller 12B, a paper feed roller 12A, and a separation roller 36.

The pickup roller 12B and the paper feed roller 12A have the same configurations as the pickup roller 22B and the paper feed roller 22A.

The separation roller 36 in the manual paper feed unit 11 has the same configuration as the separation roller 36 in the cassette paper feed unit 21 except that the separation roller 36 in the manual paper feed unit 11 is in contact with the paper feed roller 12A.

Next, the detailed configuration of the manual feed tray 13 will be described.

Figure 2:
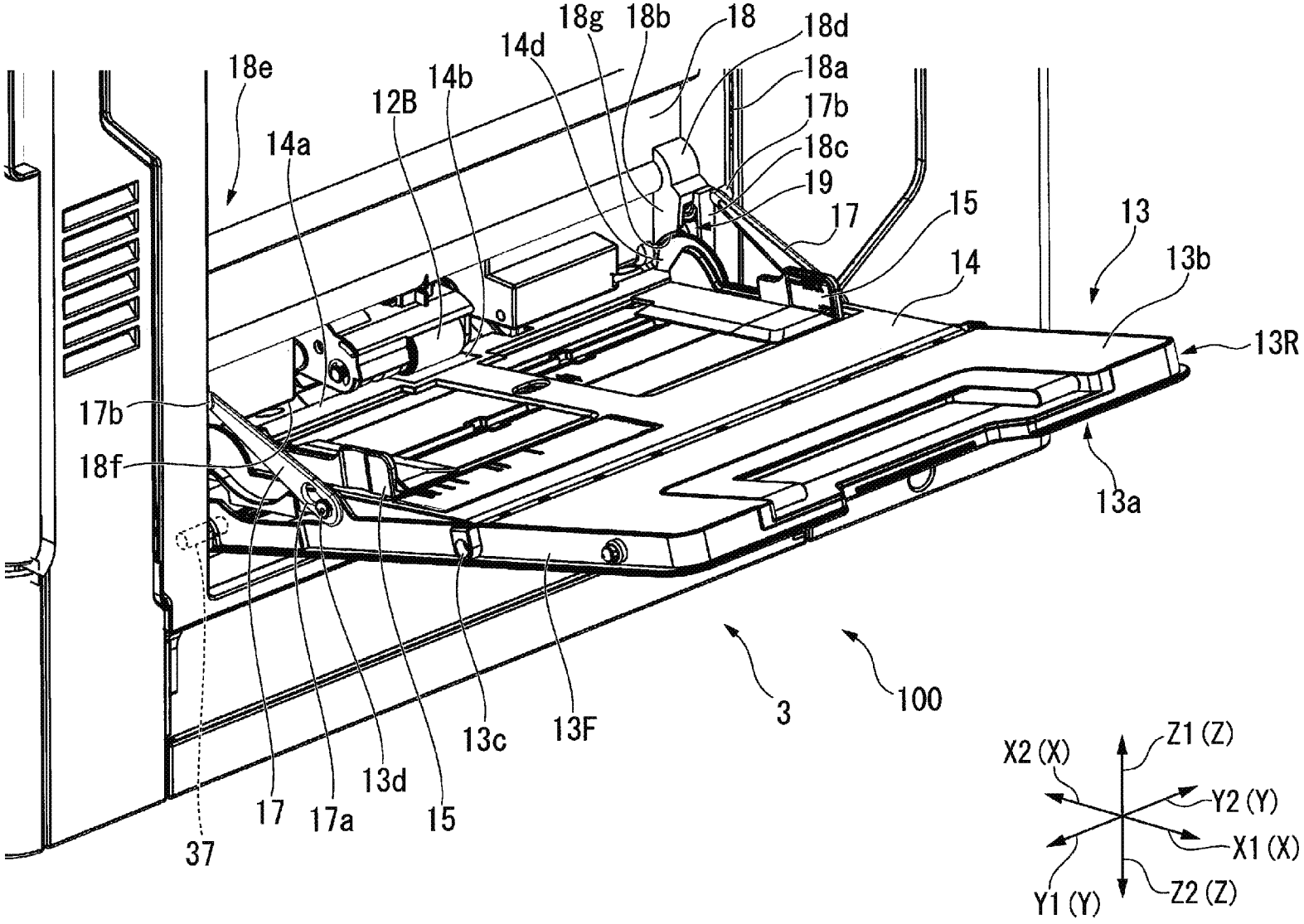
FIG. 2 is a schematic perspective view showing a manual feed tray (ascended position)
Figure 3:
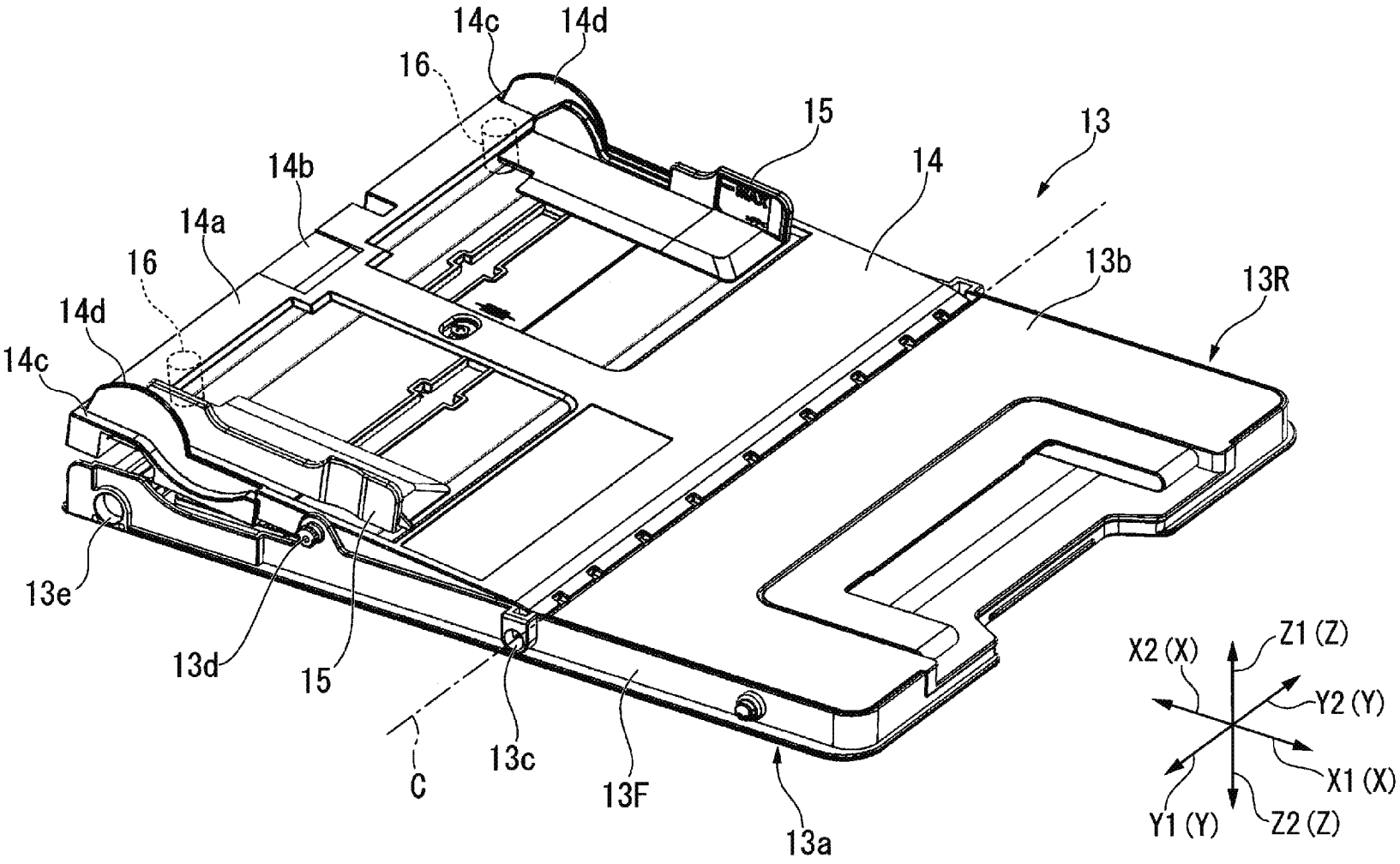
FIG. 3 is a schematic perspective view showing the outer appearance of the manual feed tray.
Figure 4:
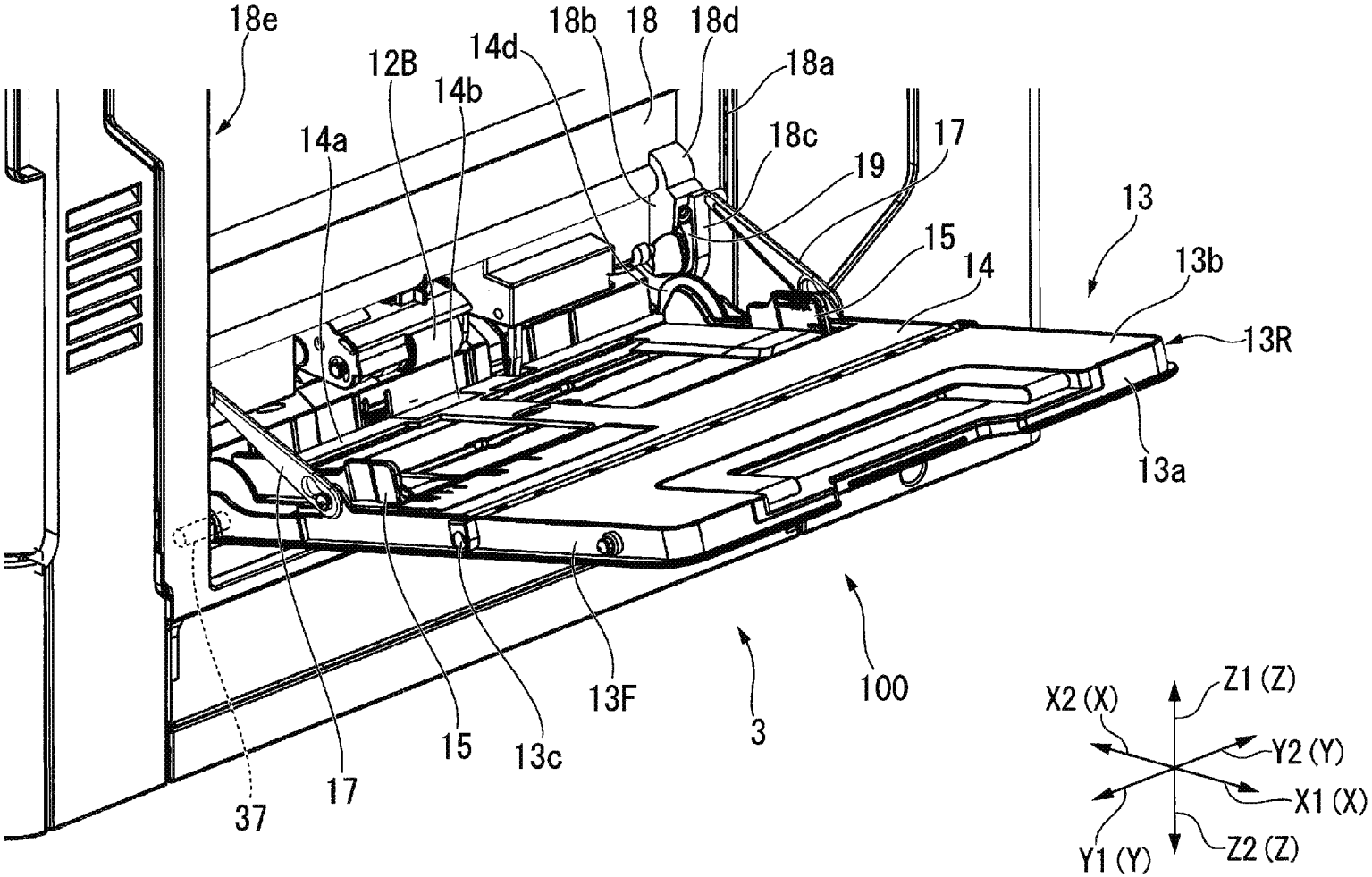
FIG. 4 is a schematic perspective view showing the manual feed tray (descended position)

FIG. 2 is a schematic perspective view showing the manual feed tray (ascended position) of the image forming apparatus according to the embodiment. FIG. 3 is a schematic perspective view showing the outer appearance of the manual feed tray of the image forming apparatus according to the embodiment. FIG. 4 is a schematic perspective view showing the manual feed tray (descended position) of the image forming apparatus according to the embodiment.

As shown in FIG. 2, the manual feed tray 13 has a flat plate shape as a whole. The manual feed tray 13 has a size that can be stored in a tray storage portion 18*e* of a side cover 18 that covers the right side surface of the printer unit 3 of the image forming apparatus 100. The tray storage portion 18*e* is dented in the X2 direction from the surface of the side cover 18. The outer shape of the tray storage portion 18*e* viewed from the X2 direction is a rectangular shape having substantially the same size as the manual feed tray 13.

A sheet feed opening 18*f* through which the sheet S can pass is formed in the lower part of the tray storage portion 18*e*. The pickup roller 12B protrudes in the X1 direction at the center in the Y direction above the sheet feed opening 18*f*.

At the lower end of the tray storage portion 18*e*, rotation support shafts 37 protrude from the inner surface of the tray storage portion 18*e* in the Y direction from the device main body covered by the side cover 18. However, in FIG. 2, only the rotation support shaft 37 protruding in the Y2 direction from the Y1 direction inner surface of the tray storage portion 18*e* is illustrated.

Each rotation support shaft 37 extends coaxially with an axis extending in the Y direction. Each of the rotation support shafts 37 is fitted into a bearing portion 13*e* of the manual feed tray 13 which will be described later. Therefore, the manual feed tray 13 is fixed to the device main body to be rotatable around each of the rotation support shafts 37.

A guide groove 18*a* extending in the Z direction is provided on each Y direction inner wall of the side cover 18. However, in FIG. 2, only the guide groove 18*a* on the inner wall in the Y2 direction is illustrated. A link 17, which will be described later, is engaged with each guide groove 18*a*.

Each link 17 holds the manual feed tray 13 at a predetermined angle with respect to the horizontal plane (XY plane) in a state where the manual feed tray 13 is opened outward from the tray storage portion 18*e*. Each link 17 connects each side surface of the manual feed tray 13 in the Y direction and each guide groove 18*a* to each other.

Each link 17 includes a connecting hole 17*a* and a connecting pin 17*b* at respective ends in the longitudinal direction.

The connecting hole 17*a* is connected to an attachment protrusion 13*d* of the manual feed tray 13 described later.

The connecting pin 17*b* is connected to each guide groove 18*a* to be movable in the Z direction.

With such a configuration, the manual feed tray 13 can rotate between the closed state and the open state. The closed state is a state in which the manual feed tray 13 is stored inside the tray storage portion 18*e* in a posture along the vertical plane. The open state is a state in which the manual feed tray 13 is opened toward the outside of the tray storage portion 18*e* in the X1 direction at an angle defined by the link 17 with respect to the horizontal plane.

The manual feed tray 13 in the open state will be described below unless otherwise specified.

As shown in FIG. 3, the manual feed tray 13 includes a bottom plate 13*a*, a front plate 13F, a rear plate 13R, an upper plate 13*b*, an elevating plate 14, guide fences 15, and biasing members 16.

The bottom plate 13*a* forms the lower surface in the open state. In the closed state, the bottom plate 13*a* is substantially flush with the outer side cover 18 of the tray storage portion 18*e*. In the closed state, the bottom plate 13*a* constitutes a part of the right side surface of the image forming apparatus 100 together with the side cover 18.

The front plate 13F protrudes upward from the end of the bottom plate 13*a* in the Y1 direction. The front plate 13F includes the bearing portion 13*e*, the attachment protrusion 13*d*, and a rotation support shaft 13*c*.

The bearing portion 13*e* supports the rotation support shaft 37 protruding from the inner wall of the tray storage portion 18*e* in the Y2 direction. The bearing portion 13*e* is formed near the leading end of the front plate 13F in the X2 direction.

The attachment protrusion 13*d* is engaged with the connecting hole 17*a* of the link 17. The attachment protrusion 13*d* protrudes in the Y1 direction from a position farther than the bearing portion 13*e* in the X1 direction.

The rotation support shaft 13*c* supports the elevating plate 14 described later to be rotatable about a central axis C of the rotation support shaft 13*c*. The rotation support shaft 13*c* protrudes in the Y2 direction from the front plate 13F.

The rear plate 13R protrudes upward from the end of the bottom plate 13*a* in the Y2 direction. The rear plate 13R has a shape that is plane-symmetrical to the front plate 13F with the ZX plane including the central axis of the bottom plate 13*a* in the Y direction as the symmetry plane. Therefore, although not illustrated in FIG. 3, the bearing portion 13*e*, the attachment protrusion 13*d*, and the rotation support shaft 13*c* that are provided in plane symmetry to the bearing portion 13*e*, the attachment protrusion 13*d*, and the rotation support shaft 13*c* in the front plate 13F are provided.

The upper plate 13*b* covers the bottom plate 13*a* located in the X1 direction of the respective rotation support shafts 13*c* from above. The upper plate 13*b* is arranged at the same height as the upper ends of the front plate 13F and the rear plate 13R.

The elevating plate 14 constitutes a mounting surface on which the sheet S (not shown) is placed, together with the upper plate 13*b*. The elevating plate 14 is arranged inside the front plate 13F and the rear plate 13R from the leading end of the upper plate 13*b* in the X2 direction to the leading end of the bottom plate 13*a* in the X2 direction. The outer shape of the elevating plate 14, when viewed from above, is a substantially rectangular shape.

A flat leading end mounting surface 14*a* that is long in the Y direction is formed at the leading end of the elevating plate 14 in the X2 direction. A friction pad 14*b* that increases the frictional force with the sheet S is arranged at the center of the leading end mounting surface 14*a* in the longitudinal direction. The friction pad 14*b* is provided at a position where the friction pad 14*b* can contact the pickup roller 12B. The friction pad 14*b* prevents double feeding of the lowermost sheet S placed on the manual feed tray 13.

An end of the elevating plate 14 in the X1 direction is rotatably supported by each rotation support shaft 13*c*. In the elevating plate 14, the biasing member 16 is arranged between the back side of the leading end mounting surface 14*a* and the bottom plate 13*a*.

The biasing member 16 is configured to push up the elevating plate 14 in a direction in which the elevating plate 14 is separated from the bottom plate 13*a*. For example, as the biasing member 16, an appropriate spring or elastic member may be used.

In the present embodiment, a compression coil spring is used as the biasing member 16. The biasing members 16 are arranged below the leading end mounting surface 14*a* and near both ends in the Y direction.

The biasing force of the biasing member 16 has a magnitude such that, when stackable sheets S are set on the elevating plate 14, the uppermost sheet S abuts the pickup roller 12B, and the uppermost sheet S produces a frictional force capable of being fed between the uppermost sheet S and the pickup roller 12B.

In the elevating plate 14, a pair of guide fences 15 is provided in a region adjacent to the leading end mounting surface 14*a* in the X1 direction. The pair of guide fences 15 holds both ends in the Y direction of the sheet S placed on the elevating plate 14 therebetween to align the direction of the sheet S in the X direction.

Each of the pair of guide fences 15 includes a protruding piece extending in the X direction above the elevating plate 14. The height of each guide fence 15 is higher than the total thickness of the number of sheets S that can be stacked on the manual feed tray 13. Each guide fence 15 is supported by the elevating plate 14 to be movable in the Y direction. The spacing between the protruding pieces in the Y direction of each guide fence 15 can be changed by the user.

In the elevating plate 14, cam contact surfaces 14*c* are formed at both ends in the Y direction at the leading end in the X2 direction. However, in FIG. 3, since the Y2 direction cam contact surface 14*c* is not visible, only the Y1 direction cam contact surface 14*c* is shown.

A cam plate portion 41*a* of a pressing member 41, which will be described later, comes into contact with the cam contact surfaces 14*c*. The shape of the cam contact surface 14*c* is not particularly limited as long as the elevating plate 14 can be pushed down toward the bottom plate 13*a* by the pressing force from the cam plate portion 41*a* described later. In the example shown in FIG. 3, each cam contact surface 14*c* is a flat surface along the leading end mounting surface 14*a*.

In the present embodiment, plate-like protrusions 14*d* are provided between each cam contact surface 14*c* and the leading end mounting surface 14*a*.

Each of the plate-shaped protrusions 14*d* has a plate shape parallel to the front plate 13F and the rear plate 13R. Each plate-shaped protrusion 14*d* protrudes above the elevating plate 14 in a mountain shape. In the X direction, each plate-shaped protrusion 14*d* extends from the leading end of the elevating plate 14 in the X2 direction to a range that extends to the leading end of the guide fence 15 in the X2 direction.

However, each plate-shaped protrusion 14*d* is not an essential component in the manual feed tray 13 and may be omitted.

With such a configuration, in the manual feed tray 13 alone, the leading end in the X2 direction of the elevating plate 14 biased by the biasing member 16 protrudes above the upper ends of the front plate 13F and the rear plate 13R. The elevating plate 14 descends toward the bottom plate 13*a* when an external force is applied to each cam contact surface 14*c* toward the bottom plate 13*a*. At the lowest position of the elevating plate 14, the upper surface of the elevating plate 14 is flush with the upper plate 13*b*.

The arrangement of the elevating plate 14 descended to the lowest position will be referred to as a descended position below. FIG. 4 shows the manual feed tray 13 in which the elevating plate 14 is moved to the descended position.

The arrangement in which the X2 direction end of the elevating plate 14 is higher than the descended position with respect to the bottom plate 13*a* is referred to as an ascended position. In the manual feed tray 13 alone shown in FIG. 3, the highest position of the ascended position of the elevating plate 14 from the bottom plate 13*a* is higher than the height from the bottom plate 13*a* to the pickup roller 12B in the state of being attached to the printer unit 3. However, as shown in FIG. 2, when attached to the printer unit 3, the ascended friction pad 14*b* contacts the pickup roller 12B. Therefore, the ascended position of the elevating plate 14 is limited to the lower side of the position where the friction pad 14*b* abuts the lower end of the pickup roller 12B.

In the open manual feed tray 13, the elevating plate 14 is normally arranged at the descended position by the elevating mechanism 40 described later. At this time, the user can place the sheet S on the elevating plate 14 and the upper plate 13*b* of the manual feed tray 13. For example, the sheet S can be placed up to a thickness corresponding to the distance from the friction pad 14*b* in the descended position to the lower end of the pickup roller 12B.

As shown in FIG. 1, the elevating mechanism 40 is provided in the device main body of the printer unit 3.

The elevating mechanism 40 switches the elevating plate 14 between the descended position and the ascended position when the manual feed tray 13 is open.

Figure 5:
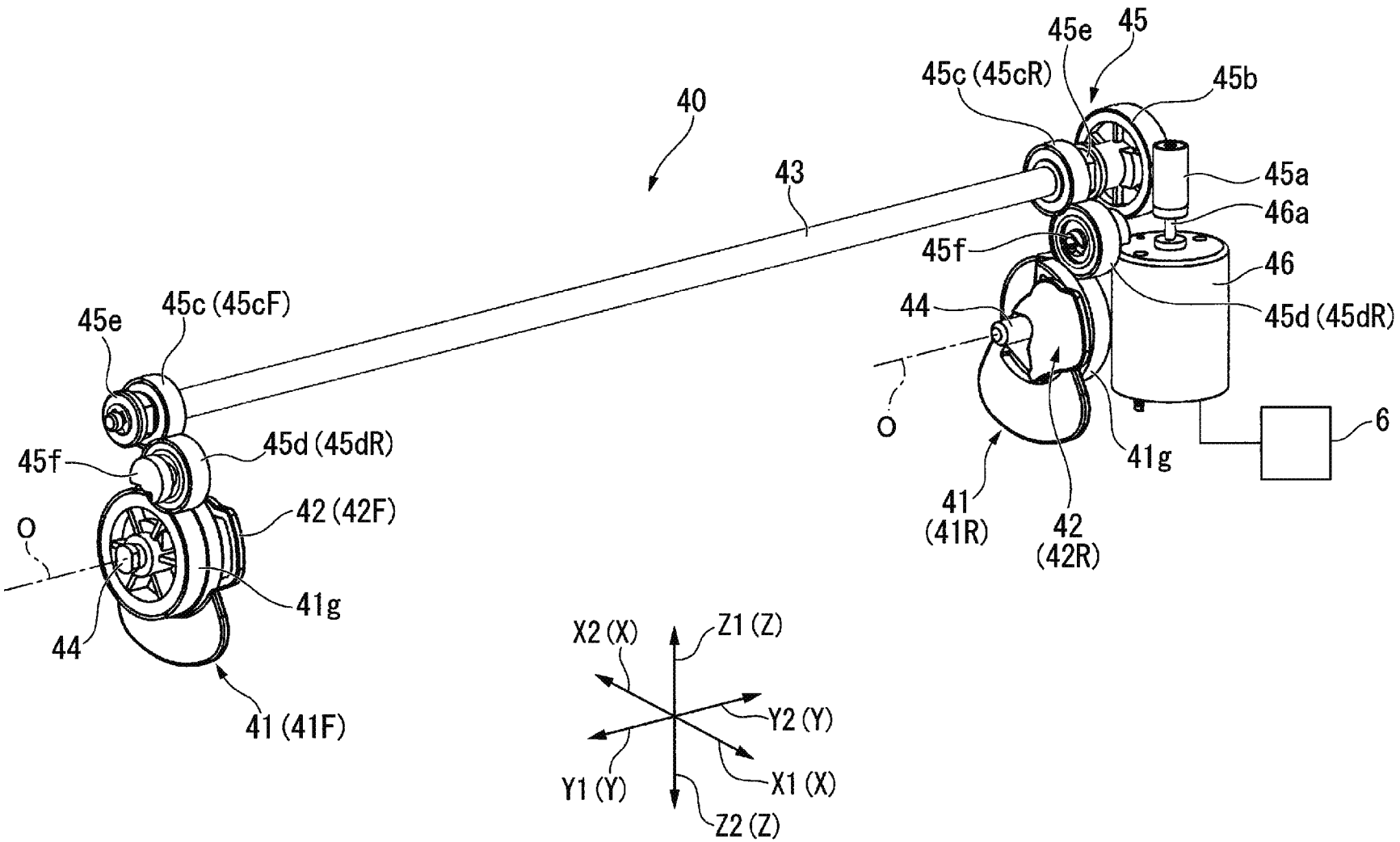
FIG. 5 is a schematic perspective view showing a configuration example of an elevating mechanism.
Figure 6:
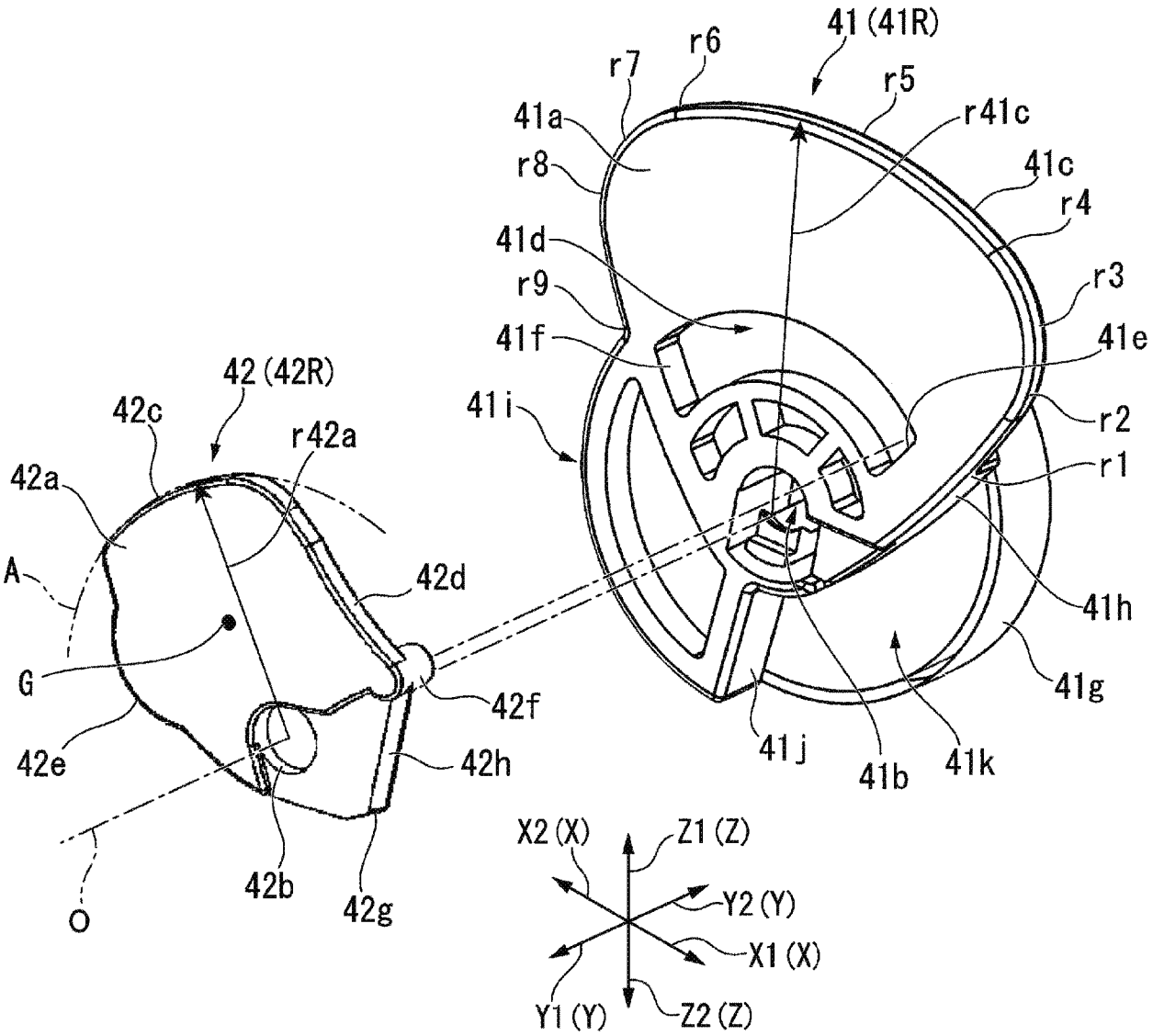
FIG. 6 is a schematic perspective view showing a configuration example of a cam and a shutter of the elevating mechanism.
Figure 7:
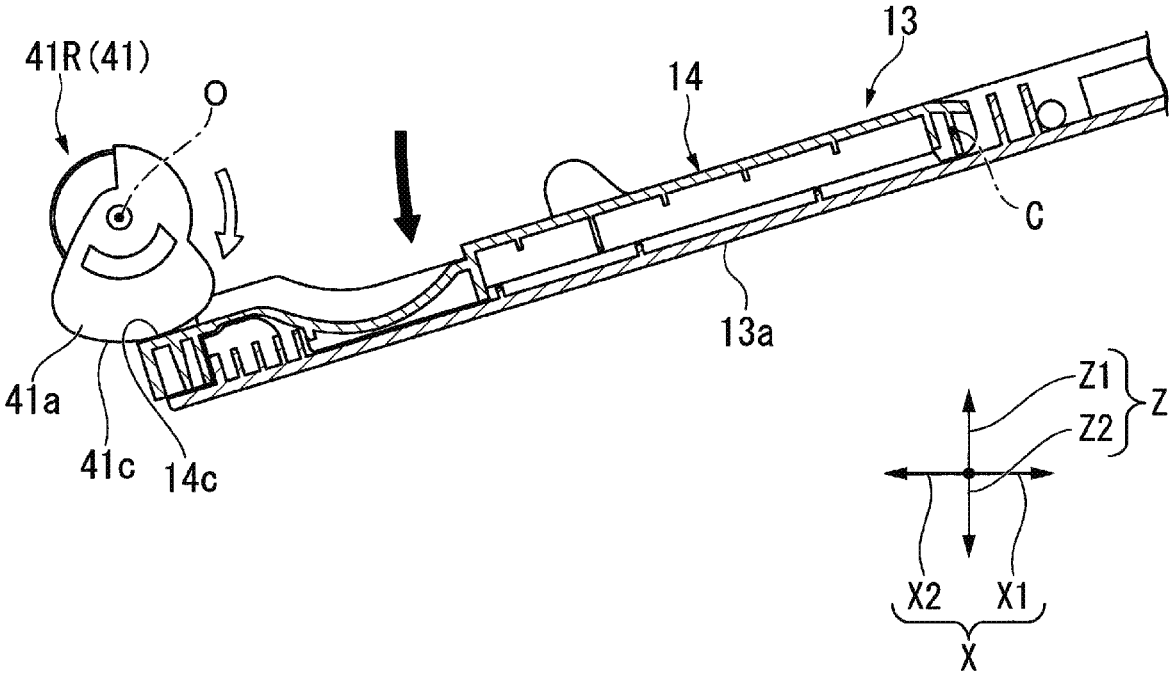
FIG. 7 is a schematic cross-sectional view showing the manual feed tray at the descended position of the elevating plate.
Figure 8:
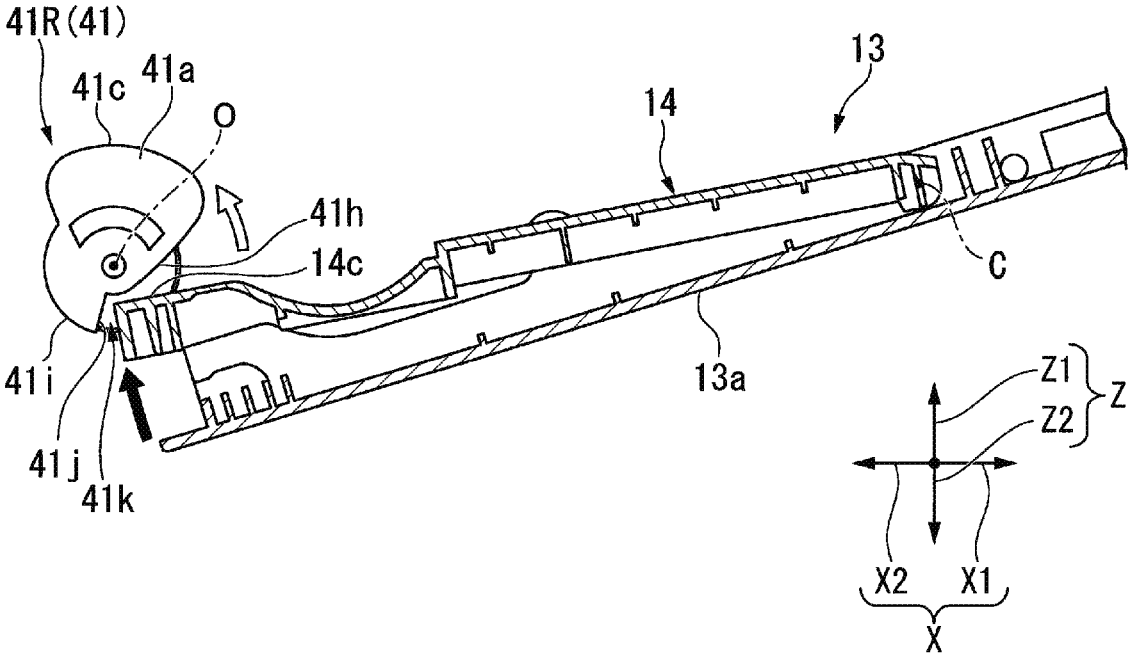
FIG. 8 is a schematic cross-sectional view showing the manual feed tray at the ascended position of the elevating plate.

FIG. 5 is a schematic perspective view showing a configuration example of the elevating mechanism in the image forming apparatus according to the embodiment. FIG. 6 is a schematic perspective view showing a configuration example of a cam and a shutter of the elevating mechanism in the image forming apparatus according to the embodiment. FIG. 7 is a schematic cross-sectional view showing the manual feed tray at the descended position of the elevating plate in the image forming apparatus according to the embodiment. FIG. 8 is a schematic cross-sectional view showing the manual feed tray at the ascended position of the elevating plate in the image forming apparatus according to the embodiment.

As shown in FIG. 5, the elevating mechanism 40 includes pressing members 41, shutters 42, a drive motor 46, and a drive transmission unit 45.

The pressing member 41 contacts each cam contact surface 14*c* (see FIG. 7, not shown in FIG. 5) of the elevating plate 14 to regulate the height of the elevating plate 14. Therefore, the pressing members 41 are provided above the respective cam contact surfaces 14*c*. When it is necessary to distinguish each pressing member 41, the pressing member 41 on the front side (Y1 direction side) is represented by a pressing member 41F, and the pressing member 41 on the rear side (Y2 direction side) is represented by a pressing member 41R.

The pressing members 41F and 41R have a plane-symmetric shape with respect to the ZX plane at the center of each arrangement position. Therefore, an example of the pressing member 41R will be described below. Regarding the shape of the pressing member 41F, the Y1 direction may be read as the Y2 direction in the description of the pressing member 41R below.

As shown in FIG. 6, the pressing member 41R includes a gear portion 41*g*, a boss portion 41*i*, and a cam plate portion 41*a* (cam).

The gear portion 41*g* receives a driving force from the drive transmission unit 45 described later. For example, the gear portion 41*g* is a spur gear. A bearing portion 41*b* penetrates in the Y direction at the center of the gear portion 41*g*.

A rotation support shaft 44 shown in FIG. 5 is inserted into the bearing portion 41*b*. The gear portion 41*g* is rotatable around the central axis O of the rotation support shaft 44. The rotation support shaft 44 protrudes in the Y1 direction from, for example, the rear plate (not shown) of the device main body that is adjacent to the gear portion 41*g* in the Y2 direction. The length of the rotation support shaft 44 is such that the rotation support shaft 44 can penetrate the pressing member 41R and a shutter 42R described later in the thickness direction.

As shown in FIG. 6, the boss portion 41*i* and the cam plate portion 41*a* are provided at the end of the gear portion 41*g* in the Y1 direction.

The boss portion 41*i* has an outer diameter slightly larger than the outer diameter of the gear portion 41*g*. The boss portion 41*i* protrudes in the Y1 direction from the end of the gear portion 41*g* in the Y1 direction. However, when viewed from the Y2 direction, the boss portion 41*i* covers about two-thirds of the circumferential direction of the gear portion 41*g*.

When viewed from the Y2 direction, a step portion 41*j*, which is the end surface of the boss portion 41*i* in the counterclockwise direction, is a flat surface that extends radially outward from the center of the gear portion 41*g*. A step portion 41*h*, which is also an end surface in the clockwise direction, is a curved surface extending along the outer shape of the cam plate portion 41*a* described later.

Therefore, a recess 41*k* is formed in the counterclockwise region from the step portion 41*j* toward the step portion 41*h*. The recess 41*k* is recessed in the Y2 direction from the boss portion 41*i* and the cam plate portion 41*a* described later. The end surface of the gear portion 41*g* in the Y1 direction is exposed in the recess 41*k*.

The cam plate portion 41*a* is a flat plate that overlaps with the clockwise end of the boss portion 41*i* when viewed from the Y2 direction. The cam plate portion 41*a* extends radially outward from the center portion of the gear portion 41*g* and has a leading end protruding radially outward. The end surface of the cam plate portion 41*a* in the Y1 direction is formed on the same plane as the end surface of the boss portion 41*i* adjacent in the counterclockwise direction in the Y1 direction.

The cam plate portion 41*a* is formed in a fan-shaped range including the bearing portion 41*b* inside the gear portion 41*g* in the radial direction. The bearing portion 41*b* penetrates the cam plate portion 41*a* in the plate thickness direction.

The end surface of the cam plate portion 41*a* that protrudes radially outward of the gear portion 41*g* is the cam surface 41*c*. The shape of the cam surface 41*c* viewed from the Y2 direction is a curved surface represented by a curve r1r2r3r4r5r6r7r8r9 (hereinafter referred to as a curve [r1-r9]). The points r1, r2, . . . , r9 on the curve [r1-r9] are arranged in this order counterclockwise about the central axis O when viewed from the Y2 direction. The curve [r1-r9] is not particularly limited to a line-symmetric shape. However, in the present embodiment, the curve [r1-r9] is line-symmetric with respect to the straight line passing through the central axis O and the point r5.

On a plane orthogonal to the central axis O and passing through the cam surface 41*c*, the distance (radius) from the central axis O to the cam surface 41*c* is referred to as a cam radius r41c. In the following, an example of the shape of the curve [r1-r9] will be described based on the change in the cam radius r41c when advancing in the counterclockwise direction at an equal angle when viewed from the Y2 direction (hereinafter, simply referred to as "advancing").

The cam radius r41c is substantially equal to the outer radius of the gear portion 41*g* at the point r1 and the point r9.

The cam radius r41c sharply increases as advancing from the point r1 to the point r2. The increasing rate of the cam radius r41c gradually decreases as advancing from the point r2 to the point r3. The increasing rate of the cam radius r41c more gradually decreases as advancing from the point r3 to the point r4. The cam radius r41c is constant as advancing from the point r4 to the point r6. In this case, the curve r4r5r6 is an arc centered on the central axis O. The central angle (∠r4Or6) of this arc is about 55 degrees.

The change of the cam surface 41*c* from the point r6 to the point r9 is the same as the change when the cam surface 41*c* advances from the point r9 to the point r6 in the clockwise direction at an equal angle.

However, the cam radius r41c may gently and gradually increase as advancing from the point r4 to the point r5, and may gently gradually decrease as advancing from the point r5 to the point r6. Here, the point r5 is a point that bisects the cam surface 41*c* between the point r4 and the point r6.

In at least one embodiment, the cam surface 41*c* is smoothly curved and connected at points r1, . . . , r9.

Due to such a shape of the cam surface 41*c*, the outer shape of the cam plate portion 41*a* viewed from the Y2 direction is a fan shape that bulges outward in the radial direction from the gear portion 41*g* as a whole. However, rounded corners are formed at both ends (points r2 to r4 and points r6 to r8) of the cam plate portion 41*a* protruding from the gear portion 41*g* in the circumferential direction.

The cam radius r41c is the maximum at least at the point r5.

A groove portion 41*d* is formed on the end surface of the cam plate portion 41*a* in the Y1 direction along an arc centered on the central axis O. The radial width and depth of the groove portion 41*d* are such that an engagement protrusion 42*f* of the shutter 42, which will be described later, can move along a circular arc around the central axis O.

A first engagement portion 41*e* (engagement member, wall portion) is formed by the groove inner wall of the groove portion 41*d* at an end of the groove portion 41*d* in the clockwise direction when viewed from the Y2 direction. The first engagement portion 41*e* can come into circumferential contact with the shutter 42, which is inserted into the groove portion 41*d* and will be described later, and engages with the shutter 42 in the circumferential direction at the time of contact. For example, the first engagement portion 41*e* is constituted of a flat surface that extends in the radial direction passing through the central axis O.

A second engagement portion 41*f* (engagement member, wall portion) is formed by the groove inner wall of the groove portion 41*d* at the end of the groove portion 41*d* in the counterclockwise direction when viewed from the Y2 direction. The second engagement portion 41*f* can come into circumferential contact with the shutter 42, which is inserted into the groove portion 41*d* and will be described later, and engages with the shutter 42 in the circumferential direction at the time of contact. For example, the second engagement portion 41*f* is constituted of a flat surface that extends in the radial direction passing through the central axis O.

The shutters 42 are arranged adjacent to each other inside the pressing members 41 in the Y direction. When it is necessary to distinguish each shutter 42, the shutter 42 inside the pressing member 41F is represented by a shutter 42F, and the shutter 42 inside the pressing member 41R is represented by a shutter 42R.

The shutters 42F and 42R have plane-symmetric shapes with respect to the ZX plane at the center of the respective arrangement positions. Therefore, an example of the shutter 42R will be described below. Regarding the shape of the shutter 42F, the Y1 direction may be read as the Y2 direction in the description of the shutter 42R below.

The shutter 42R includes a shielding portion 42*a* and the engagement protrusion 42*f* (engagement member, protrusion).

The shielding portion 42*a* is a plate portion surrounded by a leading end surface 42*c*, a lower end surface 42*d*, an upper end surface 42*e*, and a rear end surface 42*h* when viewed from the Y2 direction. Here, the lower end surface 42*d* and the upper end surface 42*e* are end surfaces that face downward and upward, respectively, when the pressing member 41 pushes down the elevating plate 14 to the descended position.

The shielding portion 42*a* has an arcuate outer shape that gently curves from the rear end surface 42*h* to the leading end surface 42*c*. The width between the lower end surface 42*d* and the upper end surface 42*e* is shorter than the length between the leading end surface 42*c* and the rear end surface 42*h*.

However, such an outer shape of the shielding portion 42*a* is an example. The outer shape of the shielding portion 42*a* is adjusted to an appropriate shape that can cover the opening portion more widely according to the shape of the opening portion that the shielding portion 42*a* needs to cover and the arrangement of surrounding members during rotation.

A through hole 42*b* penetrates in the thickness direction at an end portion closer to the rear end surface 42*h* and closer to the upper end surface 42*e* between the lower end surface 42*d* and the upper end surface 42*e*.

The through hole 42*b* is a circular hole that is fitted to the rotation support shaft 44 (not shown) to be able to rotate about the central axis O. Therefore, when the through hole 42*b* is mounted on the rotation support shaft 44, the shutter 42R can rotate about the central axis O.

The leading end surface 42*c* is formed in a shape in which an arc A having a maximum radius r42a drawn when the shielding portion 42*a* rotates is circumscribed.

In the shutter 42R, a locking portion 42*g* that can be locked by a stopper 47 described later is formed at a corner where the upper end surface 42*e* and the rear end surface 42*h* intersect.

The engagement protrusion 42*f* protrudes in the Y2 direction from the Y2 direction surface of the cam plate portion 41*a*. The engagement protrusion 42*f* is inserted into the groove portion 41*d* of the pressing member 41. When the shutter 42R rotates about the central axis O, the engagement protrusion 42*f* can move along the circumference around the central axis O between the first engagement portion 41*e* and the second engagement portion 41*f* of the pressing member 41R.

In the example shown in FIG. 6, the engagement protrusion 42*f* protrudes in the Y2 direction from the corner where the rear end surface 42*h* and the lower end surface 42*d* intersect.

The center of gravity G of the shutter 42R is located at a position that substantially bisects the lower end surface 42*d* and the upper end surface 42*e* between the through hole 42*b* and the leading end surface 42*c*. Therefore, the center of gravity G is eccentric from the central axis O toward the leading end surface 42*c*.

As shown in FIG. 5, the drive motor 46 is a motor that supplies a rotational driving force to the drive transmission unit 45 described later by the rotation of a motor shaft 46*a*. The drive motor 46 is fixed to the device main body (not shown) in the printer unit 3 via a support member (not shown). For example, the motor shaft 46*a* extends in the Z1 direction.

The drive motor 46 and the drive transmission unit 45 are used to swing the pressing members 41. The drive motor 46 is communicatively connected to the control unit 6.

The type of the drive motor 46 is not particularly limited as long as the drive motor 46 can swing the pressing members 41 in cooperation with the drive transmission unit 45. For example, the drive transmission unit 45 may include a swing mechanism that converts the rotation of the motor shaft 46*a* into a swing motion, or may not include the swing mechanism. The swing mechanism can be formed by, for example, a cam, a link, or a combination thereof.

In the following, as shown in FIG. 5, an example in which the drive transmission unit 45 does not include a swing mechanism will be described. In this case, as the drive motor 46, a motor in which the motor shaft 46*a* rotates in the forward and reverse directions is used. The type of the drive motor 46 is not particularly limited as long as the motor shaft 46*a* can be rotated in the forward and reverse directions according to the control signal from the control unit 6. For example, a DC motor, a stepping motor, or the like may be used as the drive motor 46.

However, when the drive transmission unit 45 includes a swing mechanism, the drive motor 46 may rotate in one direction.

The drive transmission unit 45 transmits the rotation of the motor shaft 46*a* to the pressing member 41. The configuration of the drive transmission unit 45 is not particularly limited as long as the rotation can be transmitted. In the example shown in FIG. 5, the drive transmission unit 45 includes a gear transmission mechanism.

The drive transmission unit 45 includes a first gear 45*a*, a second gear 45*b*, a rotary shaft 43, third gears 45*c*, and fourth gears 45*d*.

The first gear 45*a* is a worm gear fixed to the motor shaft 46*a*.

The second gear 45*b* is a worm wheel that engages with the first gear 45*a*. The second gear 45*b* extends in the Y2 direction.

The rotary shaft 43 is a rotary shaft that transmits the rotation of the second gear 45*b*. The rotary shaft 43 has a length that penetrates a front plate (not shown; the same applies hereinafter) and a rear plate (not shown; the same applies hereinafter) facing the Y direction. The rotary shaft 43 is rotatably supported by bearings 45*e* respectively arranged on the front plate and the rear plate of the device main body of the printer unit 3.

The third gear 45*c* and the fourth gear 45*d* transmit the rotation of the rotary shaft 43 to the pressing members 41F and 41R. Therefore, as the third gears 45*c* and the fourth gears 45*d*, a third gear 45*c*F and a fourth gear 45*d*F on the rear side (Y2 direction side) of the front plate, and a third gear 45*c*R and a fourth gear 45*d*R on the front side (Y1 direction side) of the rear plate are arranged.

The number of teeth and the modules of each third gear 45*c* are equal to each other. The number of teeth and the module of each fourth gear 45*d* are equal to each other.

The third gear 45*c*R is fixed to the front side of the rear plate at the rear end of the rotary shaft 43. The third gear 45*c*F is fixed to the rear side of the front plate at the leading end of the rotary shaft 43. Therefore, the third gears 45*c*R and 45*c*F rotate in the same direction as the rotation shaft 43.

The fourth gear 45*d*R is an idler gear provided in the transmission path between the third gear 45*c*R and the gear portion 41*g* of the pressing member 41R. The fourth gear 45*d*R is rotatably attached to the rotation support shaft 45*f* protruding from the rear plate in the Y1 direction.

The fourth gear 45*d*F is an idler gear provided in the transmission path between the third gear 45*c*F and the gear portion 41*g* of the pressing member 41F. The fourth gear 45*d*F is rotatably attached to the rotation support shaft 45*f* protruding from the front plate in the Y2 direction.

According to the drive transmission unit 45 having such a configuration, when the drive motor 46 rotates, the pressing members 41 rotate in synchronization with each other in the same direction. Therefore, the pressing members 41 swing around the central axis O according to the forward and reverse rotation of the drive motor 46. That is, the central axis O is a swing axis line that extends in the Y direction in the horizontal direction and in which the cam plate portion 41*a* of the pressing member 41 swings.

Although not shown in particular, the elevating mechanism 40 includes a position detection sensor for detecting the swing position of the pressing member 41. For example, the position detection sensor detects the most clockwise swing position and the most counterclockwise swing position of the pressing member 41 when viewed from the Y2 direction, and sends a detection signal to the control unit 6 described later.

The most clockwise swing position is a position where the cam plate portion 41*a* faces downward and the elevating plate 14 is pushed down to the descended position. The most clockwise swing position is the home position of the pressing member 41.

The most counterclockwise swing position is the position where the cam plate portion 41*a* faces upward and is separated from the most ascended elevating plate 14.

As shown in FIG. 1, the control unit 6 controls the entire image forming apparatus 100 and each device portion. For example, the control unit 6 controls the control panel 1, the scanner unit 2, the printer unit 3, the sheet supply unit 4, the conveyance unit 5, and the manual feed unit 10 to convey the sheet S, thereby forming an image on the sheet S.

For example, the control unit 6 sends a control signal to the drive motor 46 of the manual feed unit 10 to control the ascending and descending of the elevating plate 14.

As the device configuration of the control unit 6, for example, a processor such as a central processing unit (CPU) may be used.

Next, the operation of the image forming apparatus 100 will be described focusing on the elevating operation of the elevating plate 14 and the swinging operation of the pressing member 41 and the shutter 42 in the manual feed tray 13.

First, the image forming operation of the image forming apparatus 100 will be briefly described.

In the image forming apparatus 100 shown in FIG. 1, image formation is started by an operation of the control panel 1 or an external signal. The image information is sent to the printer unit 3 by reading the object to be copied by the scanner unit 2 or sent to the printer unit 3 from the outside. The printer unit 3 supplies the sheet S in the sheet supply unit 4 or the sheet S in the manual feed unit 10 to the registration rollers 24 based on a control signal generated by the control unit 6 based on an operation of the control panel 1 or an external signal. Hereinafter, as an example, a case where the sheet S is supplied will be described. The setting of the sheets S in the manual feed unit 10 will be described later.

When an operation input for image formation is made from the control panel 1, the control unit 6 performs control to start the sheet feeding from the sheet supply unit 4 and image formation.

The image forming units 25Y, 25M, 25C, and 25K form an electrostatic latent image on each photosensitive drum 7 based on the image information corresponding to each color. Each electrostatic latent image is developed by the developing device 8. Therefore, a toner image corresponding to the electrostatic latent image is formed on the surface of each photosensitive drum 7.

Each toner image is primarily transferred onto the intermediate transfer belt 27 by each transfer roller. As the intermediate transfer belt 27 moves, the toner images are sequentially overlapped without causing color misregistration and are sent to the transfer unit 28.

The sheet S is fed from the registration rollers 24 to the transfer unit 28. The toner image that reached the transfer unit 28 is secondarily transferred to the sheet S. The toner image secondarily transferred is fixed to the sheet S by the fixing device 29. As a result, an image is formed on the sheet S.

Next, the operation of the manual feed tray 13 will be described in detail.

In order to place the sheet S on the manual feed tray 13, it is necessary to arrange the elevating plate 14 in the descended position as shown in FIG. 4. On the other hand, in order to feed the sheet S toward the conveyance unit 5 to form an image on the sheet S placed on the manual feed tray 13, it is necessary to raise the elevating plate 14 to a position where the pickup roller 12B can contact the uppermost surface of the sheet S.

FIG. 7 is a schematic cross-sectional view showing the manual feed tray at the descended position of the elevating plate in the image forming apparatus according to the embodiment. FIG. 8 is a schematic cross-sectional view showing the manual feed tray at the ascended position of the elevating plate in the image forming apparatus according to the embodiment.

As shown in FIG. 7, in order to arrange the elevating plate 14 in the descended position, it is necessary to move the cam surface 41*c* of each pressing member 41 to a first position on the lower side by rotating the cam surface 41*c* clockwise in the drawing. At this time, the cam surface 41*c* pushes down each cam contact surface 14*c* of the elevating plate 14. The biasing members 16 (not shown) arranged between the bottom plate 13*a* and the elevating plate 14 are compressed by the pressing force from the pressing members 41.

In such a descended position of the elevating plate 14, the cam surface 41*c* at the first position is in contact with each cam contact surface 14*c* at a substantially central portion in the circumferential direction.

In the cross-sectional view shown in FIG. 7, a state in which the pressing member 41F pushes down the front cam contact surface 14*c* of the elevating plate 14 is depicted.

On the other hand, in order to raise the elevating plate 14 to the position where paper can be fed, as shown in FIG. 8, the cam surface 41*c* of each pressing member 41 is required to be rotated counterclockwise in the drawing to move upward. The cam surface 41*c* is rotatable to a second position above the first position as shown in FIG. 8. The cam surface 41*c* is separated from each cam contact surface 14*c* of the elevating plate 14 by the time when the swing from the first position to the second position is completed.

The elevating plate 14 is ascended to a position where the sheet S (not shown) can contact the pickup roller 12B by the elastic restoring force of each biasing member 16 (not shown).

The elevating plate 14 shown in FIG. 8 depicts the uppermost ascended position when the sheet S is not placed. At this time, the cam contact surface 14*c* enters the recess 41*k* of the pressing member 41 that moved to the second position and ascends to the vicinity of the step portion 41*h*. A gap is formed between the step portion 41*j* and the leading end of the elevating plate 14 in the X2 direction.

Here, the outer appearance of the side cover 18 at the descended position of the elevating plate 14 will be described.

Figure 9:
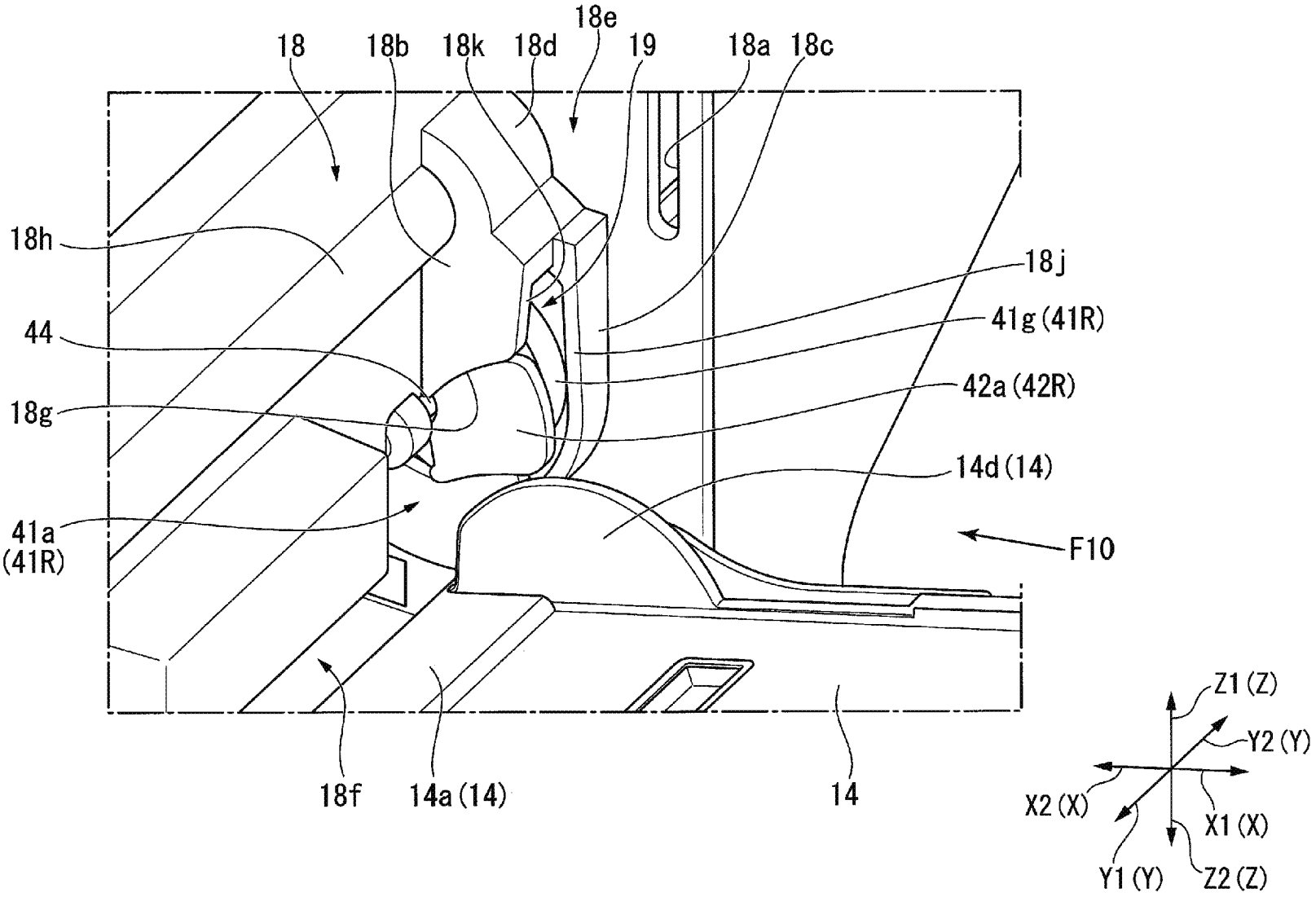
FIG. 9 is a schematic perspective view showing the arrangement of the cam and the shutter at the descended position of the elevating plate.
Figure 10:
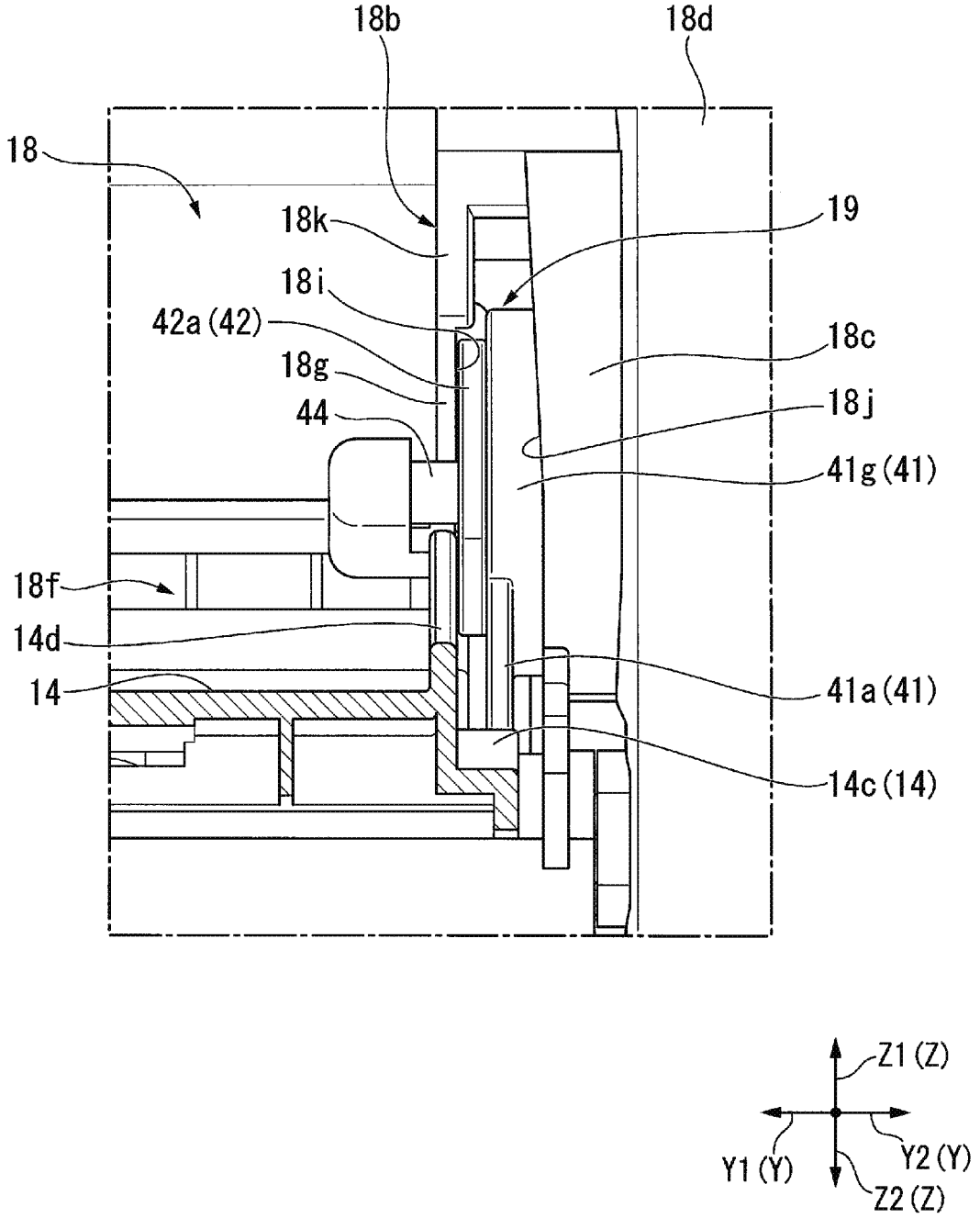
FIG. 10 is a schematic view taken along the arrow F10 in FIG. 9.

FIG. 9 is a schematic perspective view showing the arrangement of the cam and the shutter at the descended position of the elevating plate in the image forming apparatus according to the embodiment. FIG. 10 is a schematic view taken along the arrow F10 in FIG. 9.

The side cover 18 covers the elevating mechanism 40 except for a part at the upper side of the paper feed opening 18*f* and both ends in the Y direction. FIG. 9 shows the vicinity of the end of the paper feed opening 18*f* in the Y2 direction.

For example, a side surface cover portion 18*h* extending in the Y direction is formed above the paper feed opening 18*f*. The side surface cover portion 18*h* covers the entire rotary shaft 43 of the elevating mechanism 40. As a result, the user cannot touch the rotary shaft 43 from the outside of the side cover 18.

For example, inner cover portions 18*b* are formed at both ends of the side surface cover portion 18*h* in the Y direction. FIG. 9 shows the inner cover portion 18*b* in the Y2 direction.

The inner cover portion 18*b* is a plate-shaped portion that extends in the X1 direction above the rotation support shaft 44. An upper cover portion 18*d* extending in the Y2 direction toward the inner wall of the tray storage portion 18*e* is formed at the upper end of the inner cover portion 18*b*.

The upper cover portion 18*d* covers the third gear 45*c*R and the fourth gear 45*d*R (see FIG. 5) from above. The inner cover portion 18*b* covers the third gear 45*c*R and the fourth gear 45*d*R, and apart of the pressing member 41R and the shutter 42R that moved above the rotation support shaft 44. A J-shaped gear cover portion 18*c*, when viewed from the Y2 direction, extends to the lower end of the upper cover portion 18*d*.

The gear cover portion 18*c* is a wall body protruding in the Y1 direction from the inner wall portion of the tray storage portion 18*e*. When viewed from the Y2 direction, the gear cover portion 18*c* is arranged to be displaced in the X1 direction from the side end surfaces 18*k* of the inner cover portion 18*b* and the upper cover portion 18*d* in the X1 direction. Therefore, a gap that is long in the Z direction is formed between the side end surface 18*k* and the gear cover portion 18*c*. This gap has, for example, a size that the user's finger cannot enter. For example, the size of the gap is about 2 mm or less.

As shown in FIG. 10, when viewed from the X2 direction, the Y1 direction leading end surface 18*j* of the gear cover portion 18*c* is separated from the Y2 direction inner surface 18*i* of the inner cover portion 18*b* in the Y2 direction. The gap between the leading end surface 18*j* and the inner surface 18*i* has a size that allows the cam plate portion 41*a* and the shutter 42 to pass therethrough. This gap has, for example, a size that the user's finger cannot enter. For example, the size of the gap is about 6 mm or less.

As shown in FIGS. 9 and 10, the inner cover portion 18*b* extends above the plate-shaped protrusion 14*d*. A lower end surface 18*g* is formed at the lower end of the inner cover portion 18*b* to extend in an oblique direction toward the Z1 direction from the upper side of the rotation support shaft 44 in the X1 direction. As shown in FIG. 2, the lower end surface 18*g* is curved in a concave shape that extends along the shape of the upper end of the plate-shaped protrusion 14*d* when the elevating plate 14 is most ascended.

With such a configuration, opening portions 19 that are open in the Y1 direction and the X1 direction are formed in a region surrounded by the lower end surface 18*g*, the side end surface 18*k*, and the leading end surface 18*j*. The opening portion 19 is kept large enough to prevent the user's finger from entering by the operation of the shutter 42 and the elevating plate 14 described later.

The inner cover portion 18*b*, the upper cover portion 18*d*, and the gear cover portion 18*c* described above are similarly provided at the end of the side surface cover portion 18*h* in the Y1 direction. The inner cover portion 18*b*, the upper cover portion 18*d*, and the gear cover portion 18*c* in the Y1 direction similarly cover the pressing member 41F, the shutter 42F, the third gear 45*c*F, and the fourth gear 45*d*F (see FIG. 5) in the Y1 direction. The configurations of the inner cover portion 18*b*, the upper cover portion 18*d*, and the gear cover portion 18*c* in the Y1 direction are plane-symmetric to the inner cover portion 18*b*, the upper cover portion 18*d*, and the gear cover portion 18*c* in the Y2 direction described above with respect to the ZX plane. Regarding the configurations of the inner cover portion 18*b*, the upper cover portion 18*d*, and the gear cover portion 18*c* in the Y1 direction, the Y1 direction may be read as the Y2 direction and the Y2 direction may be read as the Y1 direction in the above description Next, the operation of the pressing member 41 and the shutter 42 will be described with an example of the pressing member 41R and the shutter 42R. The operations of the pressing member 41F and the shutter 42F are similar to those of the pressing member 41R and the shutter 42R, although not particularly shown.

Figure 11:
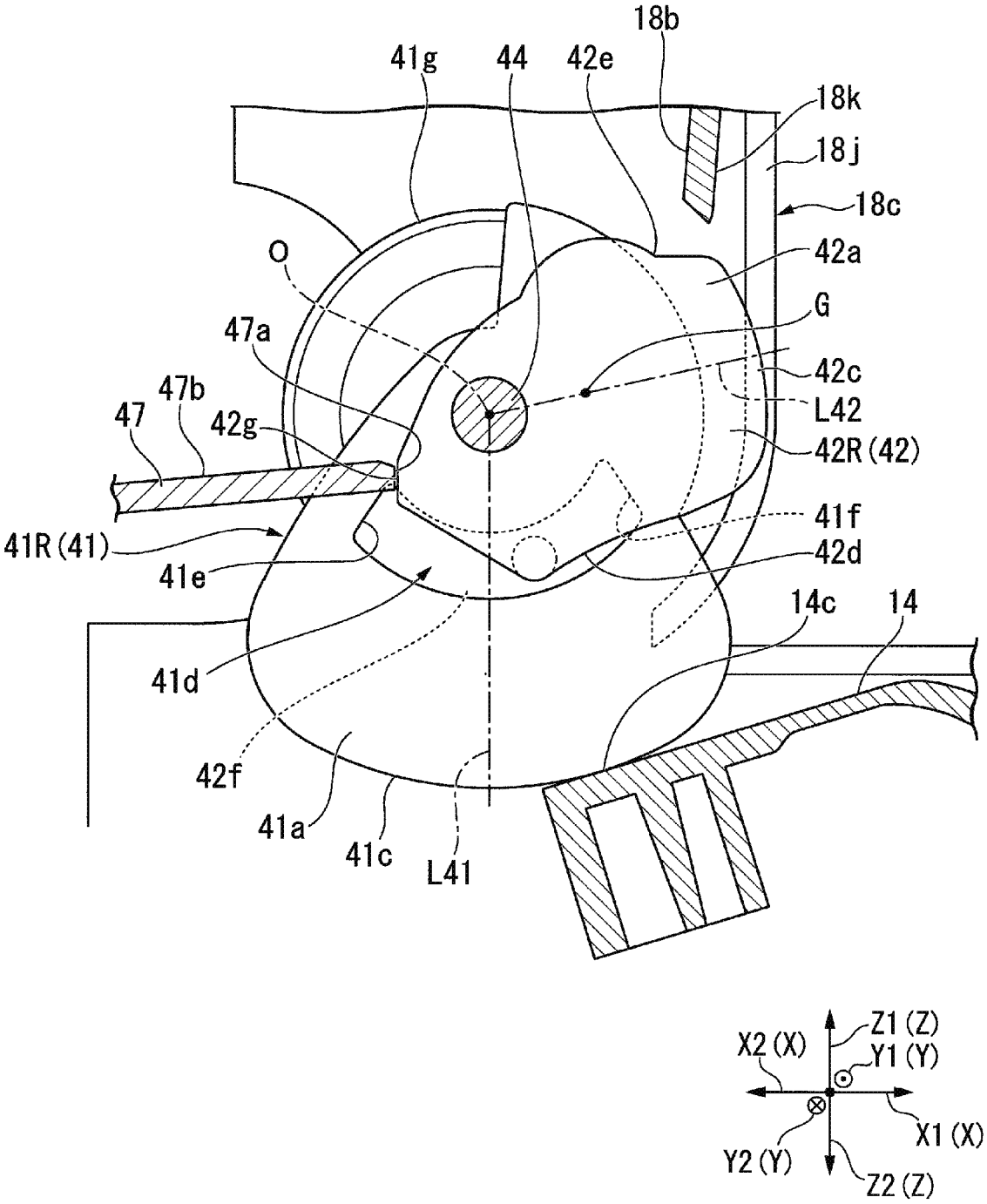
FIG. 11 is a schematic cross-sectional view showing the positions of the cam and the shutter at the descended position of the elevating plate.
Figure 12:
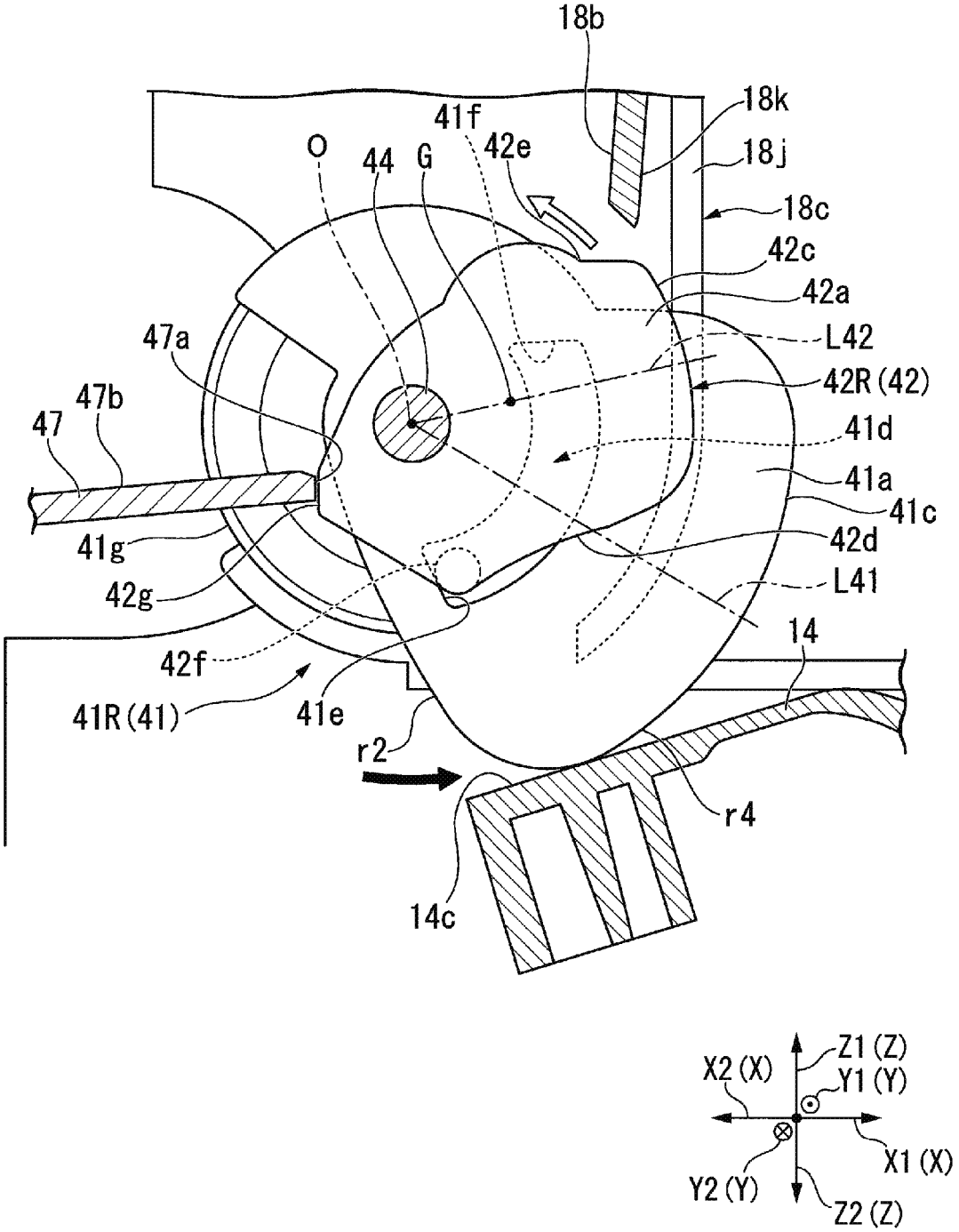
FIG. 12 is a schematic cross-sectional view showing an example of positions of the cam and the shutter while the elevating plate is ascending.
Figure 13:
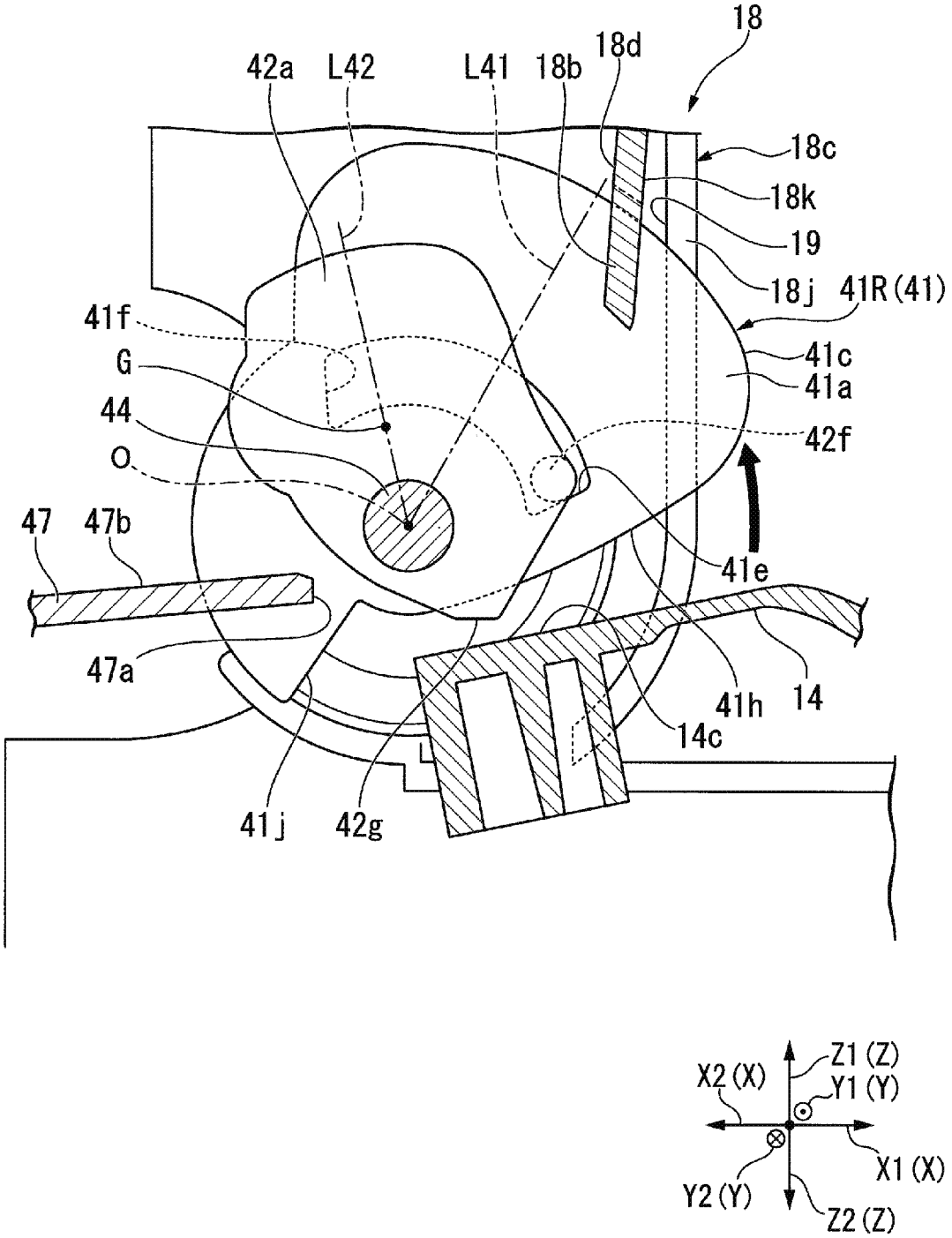
FIG. 13 is a schematic cross-sectional view showing an example of the positions of the cam and the shutter at the ascended position of the elevating plate.
Figure 14:
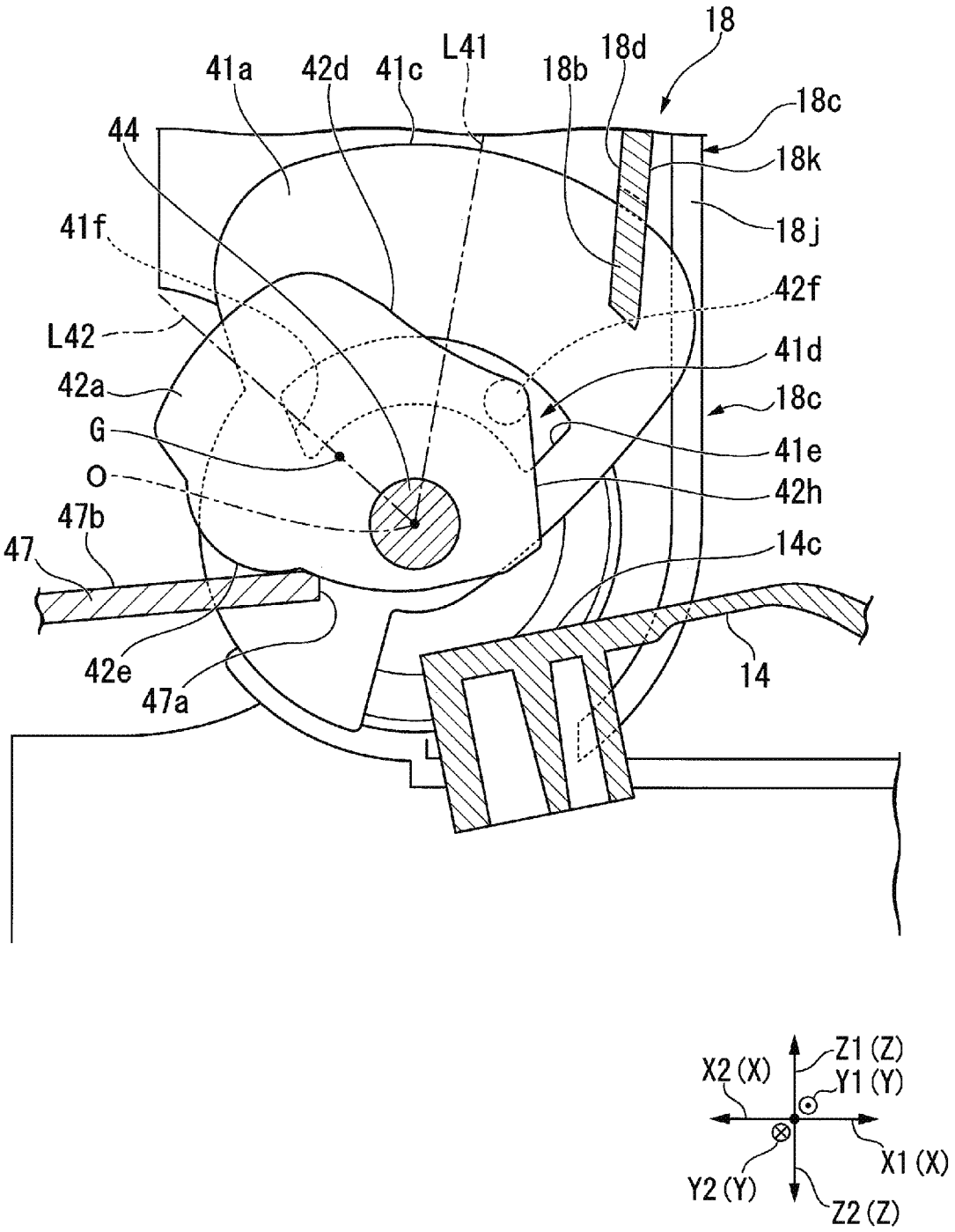
FIG. 14 is a schematic cross-sectional view showing an example of the positions of the cam and the shutter at the ascended position of the elevating plate.

FIG. 11 is a schematic cross-sectional view showing the positions of the cam and the shutter at the descended position of the elevating plate in the image forming apparatus according to the embodiment. FIG. 12 is a schematic cross-sectional view showing an example of the positions of the cam and the shutter while the elevating plate is ascending in the image forming apparatus according to the embodiment. FIGS. 13 and 14 are schematic cross-sectional views showing examples of the positions of the cam and the shutter at the ascended position of the elevating plate in the image forming apparatus according to the embodiment. FIGS. 11 to 14 are cross-sectional views as viewed from the Y2 direction. Hereinafter, the rotation directions of the pressing member 41 and the shutter 42 will be described in the clockwise and counterclockwise directions in FIGS. 11 to 14 unless otherwise specified.

In the following, in order to describe the rotational positions of the pressing member 41R and the shutter 42R, axes L41 and L42 may be referred to, respectively. The axis L41 extends from the central axis O toward the cam surface 41*c* and bisects the cam plate portion 41*a*. The axis L42 extends from the central axis O through the center of gravity G of the shutter 42R toward the leading end surface 42*c*.

As shown in FIG. 11, when the elevating plate 14 is located at the descended position, the pressing member 41R has moved to the home position. At the home position, the cam surface 41*c* is arranged at the first position. At this time, the axis L41 of the pressing member 41R extends substantially along the vertical axis. The cam surface 41*c* is in contact with the cam contact surface 14*c* of the elevating plate 14. The elevating plate 14 is biased upward by the biasing member 16 (not shown).

The stopper 47 that regulates the rotation of the shutter 42R is provided on the X2 direction side of the rotation support shaft 44. For example, the stopper 47 is a plate or a ridge that extends substantially horizontally. The stopper 47 is provided on an appropriate device main body. For example, the stopper 47 may be provided on apart of the paper feed guide member.

An upper locking portion 47*b* that locks the upper end surface 42*e* of the shutter 42R is formed on the upper side of the stopper 47. A leading end locking portion 47*a* that locks the locking portion 42*g* of the shutter 42R is formed at the leading end of the stopper 47 in the X1 direction.

When the elevating plate 14 is located at the descended position, the shutter 42R has the lower end surface 42*d* located on the lower side thereof, and the leading end surface 42*c* overlapped with the leading end surface 18*j* when viewed from the Y2 direction. The axis L42 extends substantially horizontally. As a result, as shown in FIG. 9, the shielding portion 42*a* covers the opening region between the lower end surface 18*g* and the plate-like protrusion 14*d* in the opening portion 19 from the Y2 direction.

The arrangement of the shielding portion 42*a* thus arranged overlaps with the region in the height direction occupied by the cam plate portion 41*a* at the second position when viewed from the Y2 direction and is therefore referred to as a shielding position.

As shown in FIG. 11, the center of gravity G of the shutter 42R is separated from the central axis O in the X1 direction. A moment of a clockwise force with respect to the central axis O acts on the shutter 42R due to its weight. However, since the locking portion 42*g* is locked to the leading end locking portion 47*a* of the stopper 47 provided in the device main body, the clockwise rotation of the shutter 42R is prevented.

The engagement protrusion 42*f* is inserted into a substantially central portion of the groove portion 41*d* in the longitudinal direction. The engagement protrusion 42*f* is not in contact with any inner surface of the groove portion 41*d*. Therefore, the shutter 42R can rotate clockwise in the range of the groove portion 41*d* when an external force in the counterclockwise direction acts on the shielding portion 42*a*.

In the present embodiment, in FIG. 11, the swinging direction in which the cam plate portion 41*a* moves from the first position to the second position is the counterclockwise direction. The leading end surface 42*c*, which is the leading end of the shielding portion 42*a* of the shutter 42, is located downstream of the engagement protrusion 42*f* in the counterclockwise direction. Therefore, when the engagement protrusion 42*f* rotates counterclockwise, most of the shielding portion 42*a* including the leading end surface 42*c* moves to the downstream side ahead of the engagement protrusion 42*f*.

Such a descended position of the elevating plate 14 is automatically formed under the control of the control unit 6 when the manual feed tray 13 is opened. That is, when the control unit 6 detects that the manual feed tray 13 is opened, the detection signal of the position detection sensor of the pressing member 41R is referred to. When the pressing member 41R is out of the home position based on the detection output, the control unit 6 drives the drive motor 46 to rotate each pressing member 41 to the home position. Each pressing member 41 moves the elevating plate 14 to the descended position by the cam plate portion 41*a* pushing down the elevating plate 14.

When the elevating plate 14 moves to the descended position, the user can place the sheet S on the upper surface of the manual feed tray 13.

When an image formation start signal is generated by an operation of the control panel 1 or an external signal, the control unit 6 sends a control signal to the drive motor 46 to rotate the pressing member 41 upward.

For example, FIG. 12 shows a state in which the pressing member 41R is rotated counterclockwise and the first engagement portion 41*e* and the engagement protrusion 42*f* are in contact with each other. At this time, the cam plate portion 41*a* is in contact with the cam contact surface 14*c* between the points r4 and r2 on the cam surface 41*c*.

The elevating plate 14 is elevated from the descended position corresponding to the distance from the central axis O at the contact portion.

When the pressing member 41R is further rotated counterclockwise, a rotating force acts on the shutter 42R from the engagement protrusion 42*f* that engages with the first engagement portion 41*e* according to the rotational position of the first engagement portion 41*e*. As a result, the shutter 42R rotates counterclockwise in conjunction with the rotation of the pressing member 41R.

With this rotation, the locking portion 42*g* is separated from the leading end locking portion 47*a*. The engagement protrusion 42*f* is locked to the first engagement portion 41*e* by gravity while the moment of gravity acts in the clockwise direction.

When the pressing member 41R further rotates counterclockwise, the elevating plate 14 reaches the ascending limit. At this time, the cam plate portion 41*a* is separated upward from the cam contact surface 14*c*. Here, the ascending limit of the elevating plate 14 differs depending on the stacking height of the sheets S. For example, when the sheet S is not placed, the elevating plate 14 stops at the highest ascended position of the elevating plate 14 itself.

For example, in the example shown in FIG. 13, the elevating plate 14 reaches the ascending limit. The cam plate portion 41*a* of the pressing member 41R passes through the lower opening portion 19 at the lower end of the upper cover portion 18*d*, and a part of the cam plate portion 41*a* moves into the side cover 18. The first engagement portion 41*e* is moving substantially horizontally.

The engagement protrusion 42*f* is locked to the first engagement portion 41*e* from above. The center of gravity G of the shutter 42R is located substantially above the central axis O. That is, the axis L42 extends substantially in the Z1 direction. That is, since the leading end of the shielding portion 42*a* is located on the downstream side of the engagement protrusion 42*f* in the counterclockwise direction, the center of gravity G reaches above the central axis O before the engagement protrusion 42*f* reaches above the central axis O.

From this state, when the pressing member 41R further rotates counterclockwise, the center of gravity G moves in the X2 direction from the central axis O. As a result, a counterclockwise moment due to gravity acts on the shutter 42R, and the counterclockwise rotation of the shutter 42R is accelerated.

As a result, as shown in FIG. 14, the shutter 42R rotates counterclockwise before the pressing member 41R. The engagement protrusion 42*f* is separated from the downstream side of the first engagement portion 41*e* in the counterclockwise direction.

When the pressing member 41R reaches the most counterclockwise swing position, the position detection sensor (not shown) sends a detection signal to the control unit 6. Upon receiving this detection signal, the control unit 6 sends a control signal to the drive motor 46 to stop the rotation of the drive motor 46.

On the other hand, the shutter 42R is further rotated by its weight to a position where the upper end surface 42*e* is locked by the upper locking portion 47*b* from above. At this time, most of the shielding portion 42*a* moves to the X2 direction side from the rotation support shaft 44. The rear end surface 42*h* is located along the substantially vertical line on the most X1 direction side in the shutter 42R.

In this way, the shielding portion 42*a* of the shutter 42R is retracted from the shielding position to the upper locking portion 47*b* by the time the cam plate portion 41*a* moves from the first position to the second position.

In this way, the counterclockwise rotation of the pressing member 41R and the shutter 42R is completed. At this time, the cam plate portion 41*a* of the pressing member 41R is moved to the second position.

The end of the cam plate portion 41*a* at the second position in the X1 direction overlaps with the leading end surface 18*j* when viewed from the Y2 direction. The cam plate portion 41*a* below the cam surface 41*c* is moved to a position where the elevating plate 14 is substantially overlapped with the arrangement region of the shielding portion 42*a* at the shielding position in the descended position. As a result, a part of the opening portion 19 between the side end surface 18*k* and the leading end surface 18*j* is covered by the cam plate portion 41*a* instead of the shielding portion 42*a*.

Figure 15:
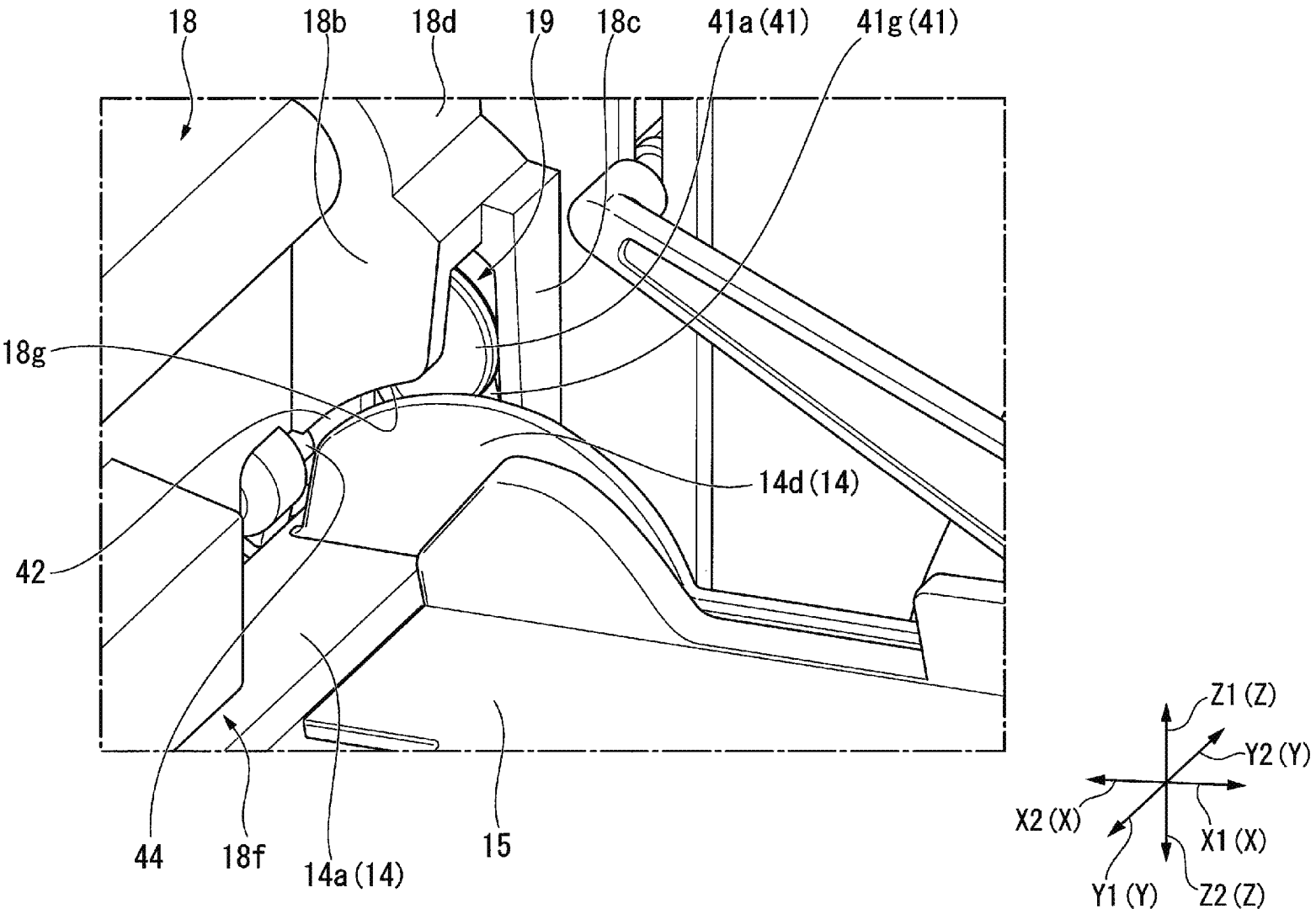
FIG. 15 is a schematic perspective view showing the arrangement of the cam and the shutter at the ascended position of the elevating plate.

As shown in FIG. 15, the opening portion 19 is substantially covered by the cam plate portion 41*a* that moved upward, and the lower side of the lower end surface 18*g* is also covered by the plate-shaped protrusion 14*d* that ascended together with the elevating plate 14. Therefore, even when the elevating plate 14 is at the ascended position, the opening portion 19 does not have a gap into which the user's finger can be inserted.

Since the shutter 42R is retracted onto the upper locking portion 47*b* inside the side cover 18, for example, the elevating plate 14 and a member provided on the elevating plate 14 can advance below the cam plate portion 41*a*.

In this way, when the elevating plate 14 moves to the ascended position, the sheet S is fed and image formation is performed. When the paper feed required for image formation is completed, the control unit 6 moves the elevating plate 14 to the descended position.

The movement of the elevating plate 14 from the ascended position to the descended position is performed in the reverse order to the above by the control unit 6 reversely rotating the drive motor 46.

However, in the clockwise rotation, the difference from the above-described operation is the fact that the shutter 42R in which the engagement protrusion 42*f* of the shutter 42R engages with the second engagement portion 41*f* is interlocked with the pressing member 41R until the center of gravity G moves in the X1 direction from the central axis O.

When the pressing member 41R and the shutter 42R rotate clockwise to move the elevating plate 14 to the descended position, the pressing member 41R and the shutter 42R return to the position to cover the opening portion 19 in a state in which there is no gap into which a user's finger can be inserted, as shown in FIGS. 9 and 10.

As described above, according to the image forming apparatus 100 of at least one embodiment, a part of the opening portion 19 is covered by the shutter 42 at the descended position of the elevating plate 14, and by the cam plate portion 41*a* at the ascended position of the elevating plate 14, respectively. Therefore, it is possible to provide an image forming apparatus capable of reducing the opening portion around the elevating mechanism when ascending and descending the elevating plate in the manual paper feed.

In the image forming apparatus 100, a part of the elevating mechanism 40 moves forward and backward from the side cover 18 through the opening portion 19, so that the space in the side cover 18 occupied by the elevating mechanism 40 can be reduced. Therefore, the manual feed unit 10 including the elevating mechanism 40 on the side surface of the printer unit 3 can be made compact and miniaturized.

At that time, the opening portion 19 is kept reduced by the cam plate portion 41*a* of the pressing member 41 and the shielding portion 42*a* of the shutter 42 which are interlocked with each other. Therefore, when the elevating plate 14 is ascended and descended, it is possible to prevent the user from entering the opening portion 19 with a finger or pinching the finger in the gap.

In particular, in at least one embodiment, when the engagement protrusion 42*f* of the shutter 42 engages with the first engagement portion 41*e* or the second engagement portion 41*f*, the rotation starts in conjunction with the cam plate portion 41*a*. However, when the center of gravity G exceeds above the central axis O in the rotation direction, the shutter 42 moves ahead of the engaged first engagement portion 41*e* or second engagement portion 41*f* in the rotation direction. Therefore, the shutter 42 can move within a range wider than the amount of rotation of the first engagement portion 41*e* or the second engagement portion 41*f* without receiving the driving force.

As a result, in at least one embodiment, the arrangement of the shielding portion 42*a* can be switched between the shielding position and the position retracted from the shielding position with a simple configuration without using a dedicated drive unit that drives the shutter 42.

Hereinafter, modified examples of the above-described embodiment will be described.

In the description of at least one embodiment, the engagement protrusion 42*f* protrudes from the shutter 42, and the groove portion 41*d* including the first engagement portion 41*e* and the second engagement portion 41*f* is formed in the cam plate portion 41*a*. However, in order to realize the engagement between the pressing member 41 and the shutter 42 at the time of swing as described above, for example, a groove portion similar to the groove portion 41*d* may be formed in the shutter 42, and an engagement protrusion similar to the engagement protrusion 42*f* may be formed on the cam plate portion 41*a*.

Further, the wall portion is not limited to the groove inner wall as long as one of the shutter and the cam includes a protrusion, and the other of the shutter and the cam includes two wall portions provided at positions sandwiching the protrusion on a circumference around the swing axis. For example, the wall portion may be a protrusion, or the groove portion connected to the wall portion may not be provided.

In the description of at least one embodiment, the description is made in which the cam swings to move between the first position and the second position. However, the cam may move without swinging as long as the cam can move between the first position and the second position. For example, the cam may move in parallel.

As described above, according to at least one embodiment described above, by including the cam plate portion 41*a* and the shutter 42, it is possible to provide an image forming apparatus capable of reducing the opening portion around the elevating mechanism when ascending and descending the elevating plate in the manual paper feed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a tray configured to hold sheets;

an elevating plate arranged on the tray and arranged to ascend and descend between a descended position for setting a sheet of the sheets and an ascended position higher than the descended position;

a cam movable between a first position where the elevating plate is arranged at the descended position and a second position where the elevating plate moves to the ascended position;

a shutter including a shielding portion, wherein the shielding portion is located at a shielding position that overlaps with a region in a height direction occupied by the cam at the second position when the cam moves to the first position, and the shielding portion retracts from the shielding position when the cam has moved from the first position to the second position; and a stopper arranged to lock a locking portion of the shutter.

2. The apparatus according to claim 1, wherein the shielding portion is plate-shaped.

3. The apparatus according to claim 1, wherein the stopper is a plate or a ridge extending horizontally.

4. The apparatus according to claim 1, wherein the cam is arranged to swing between the first position and the second position.

5. The apparatus according to claim 1, wherein the shutter and the cam include engagement members arranged to engage with each other in a moving direction of the cam, the engagement members engage at least the cam heading from the first position to the second position and the shutter located at the shielding position, and the shutter is interlocked with the cam when the engagement members are engaged.

6. The apparatus according to claim 5, where the engagement members include groove portions arranged to engage at least one of the cam or the shutter.

7. The apparatus according to claim 5, where the engagement members are arranged to engage at least one of the cam or the shutter in a circumferential direction.

8. The apparatus according to claim 1, further comprising a biasing member arranged to push up the elevating plate.

9. The apparatus according to claim 1, further comprising guide plates arranged to align the sheets.

10. The apparatus according to claim 1, further comprising a drive transmission arranged to drive the cam and the shutter.

11. The apparatus according to claim 10, further including a gear portion, wherein the drive transmission is arranged to drive the cam and the shutter via the gear portion.

12. An image forming apparatus, comprising:

a tray configured to hold sheets;

an elevating plate arranged on the tray and arranged to ascend and descend between a descended position for setting a sheet of the sheets and an ascended position higher than the descended position;

a cam movable between a first position where the elevating plate is arranged at the descended position and a second position where the elevating plate moves to the ascended position; and a shutter including a shielding portion, wherein the shielding portion is located at a shielding position that overlaps with a region in a height direction occupied by the cam at the second position when the cam moves to the first position, and the shielding portion retracts from the shielding position when the cam has moved from the first position to the second position, the shutter and the cam include engagement members arranged to engage with each other in a moving direction of the cam, the engagement members engage at least the cam heading from the first position to the second position and the shutter located at the shielding position, and the shutter is interlocked with the cam when the engagement members are engaged, the cam is arranged to swing around a horizontally extending swing axis, the shutter is rotatably provided around the swing axis, and the engagement member includes a protrusion provided on one of the shutter or the cam, and multiple wall portions provided on the other of the shutter or the cam at positions sandwiching the protrusion on a circumference around the swing axis.

13. The apparatus according to claim 12, wherein the one of the shutter or the cam is the shutter, and a leading end of the shielding portion is located downstream of the protrusion in a direction in which the cam is directed from the first position to the second position.

14. An image forming apparatus, comprising:

a tray configured to hold sheets;

an elevating plate arranged on the tray and arranged to ascend and descend between a descended position for setting a sheet of the sheets and an ascended position higher than the descended position;

a cam movable between a first position where the elevating plate is arranged at the descended position and a second position where the elevating plate moves to the ascended position; and a shutter including a shielding portion, wherein the shielding portion is located at a shielding position that overlaps with a region in a height direction occupied by the cam at the second position when the cam moves to the first position, and the shielding portion retracts from the shielding position when the cam has moved from the first position to the second position, the shutter and the cam include engagement members arranged to engage with each other in a moving direction of the cam, the engagement members engage at least the cam heading from the first position to the second position and the shutter located at the shielding position, the shutter is interlocked with the cam when the engagement members are engaged, the cam is arranged to swing around a horizontally extending swing axis, and the shutter is rotatably provided around the swing axis.

* * * * *